US010406806B2

(12) United States Patent
Matsuda

(10) Patent No.: US 10,406,806 B2
(45) Date of Patent: Sep. 10, 2019

(54) INKJET HEAD, METHOD FOR MANUFACTURING THE SAME, AND INKJET PRINTER

(71) Applicant: KONICA MINOLTA, INC., Chiyoda-ku, Tokyo (JP)

(72) Inventor: Shinya Matsuda, Takarazuka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/522,995

(22) PCT Filed: Sep. 24, 2015

(86) PCT No.: PCT/JP2015/076876
§ 371 (c)(1),
(2) Date: Apr. 28, 2017

(87) PCT Pub. No.: WO2016/067792
PCT Pub. Date: May 6, 2016

(65) Prior Publication Data

US 2017/0313060 A1 Nov. 2, 2017

(30) Foreign Application Priority Data

Oct. 29, 2014 (JP) ..... 2014-220392

(51) Int. Cl.
*B41J 29/38* (2006.01)
*B41J 2/045* (2006.01)
(Continued)

(52) U.S. Cl.
CPC ..... *B41J 2/04541* (2013.01); *B41J 2/015* (2013.01); *B41J 2/04581* (2013.01); *B41J 2/14* (2013.01);
(Continued)

(58) Field of Classification Search
None
See application file for complete search history.

(56) References Cited

U.S. PATENT DOCUMENTS

2007/0091145 A1* 4/2007 Takahashi ..... B41J 2/055 347/54
2013/0016152 A1* 1/2013 Nonoyama ..... B41J 2/14233 347/17
2014/0063095 A1 3/2014 Yokoyama et al.

FOREIGN PATENT DOCUMENTS

JP 03140252 A 6/1991
JP 2009196197 A 9/2009
(Continued)

OTHER PUBLICATIONS

International Search Report corresponding to Application No. PCT/JP2015/076876; dated Dec. 22, 2015, with English translation.
(Continued)

*Primary Examiner* — Matthew Luu
*Assistant Examiner* — Tracey M McMillion
(74) *Attorney, Agent, or Firm* — Cantor Colburn LLP

(57) ABSTRACT

A pressure chamber of each of channels of an inkjet head has a non-rotating body shape around an axis perpendicular to a support substrate on which the pressure chamber is formed. The direction of the pressure chamber corresponding to a rotation angle from a reference position around the axis passing through the pressure chamber is defined as the direction of the pressure chamber. A plurality of channels arranged in a same row in a direction parallel to the substrate includes channels and having the pressure chamber facing different directions. In a same row, channels (e.g. channel 21$a_1$) driven by a same circuit element (e.g. circuit element) are arranged such that the pressure chambers face a same direction.

19 Claims, 18 Drawing Sheets

(51) Int. Cl.
*B41J 2/015* (2006.01)
*B41J 2/14* (2006.01)
*B41J 2/16* (2006.01)

(52) U.S. Cl.
CPC ..... *B41J 2/1404* (2013.01); *B41J 2/14072* (2013.01); *B41J 2/16* (2013.01); *B41J 2/1607* (2013.01); *B41J 2/1623* (2013.01)

(56) References Cited

FOREIGN PATENT DOCUMENTS

| | | | |
|---|---|---|---|
| JP | 2010076276 | A | 4/2010 |
| JP | 2010131862 | A | 6/2010 |
| JP | 2012006239 | A | 1/2012 |
| JP | 4935965 | B2 | 5/2012 |
| JP | 2013018279 | A | 1/2013 |
| JP | 2013046988 | A | 3/2013 |
| JP | 2014050997 | A | 3/2014 |
| JP | 2014065228 | A | 4/2014 |

OTHER PUBLICATIONS

Written Opinion of the International Searching Authority corresponding to Application No. PCT/JP2015/076876; dated Dec. 22, 2015.

JPO Notice of Reasons for Rejection corresponding to Application No. 2016-556436; dated Aug. 7, 2018.

Extended European Search Report corresponding to Application No. 15854271.2-1019/3213920 PCT/JP2015076876; dated May 3, 2018.

* cited by examiner

INKJET HEAD, METHOD FOR MANUFACTURING THE SAME, AND INKJET PRINTER

CROSS REFERENCE TO RELATED APPLICATIONS

This is the U.S. national stage of application No. PCT/JP2015/076876, filed on Sep. 24, 2015. Priority under 35 U.S.C. § 119(a) and 35 U.S.C. § 365(b) is claimed from Japanese Application No. 2014-220392, filed Oct. 29, 2014, the disclosure of which is also incorporated herein by reference.

TECHNICAL FIELD

The present invention relates to an inkjet head including a plurality of channels configured to eject ink from a pressure chamber by the drive of an actuator, a method for manufacturing the same, and an inkjet printer including the inkjet head.

BACKGROUND ART

There are known inkjet printers that print texts and patterns by ejecting liquid ink onto a recording medium such as a sheet and a cloth. Such inkjet printers are capable of outputting a two-dimensional image onto a recording medium such as a sheet, cloth, or the like, by controlling ink ejection while moving the inkjet head having a plurality of channels (ink ejector), relative to the recording medium. The ink ejection can be performed by using an actuator (a piezoelectric actuator, an electrostatic actuator, a thermal actuator, or the like), or by generating air bubbles on the ink within a tube by heat. In particular, piezoelectric actuators have recently been widely used for their advantages of large output, modulability, high responsiveness, adaptability to any type of ink, or the like.

The piezoelectric actuator is classified into two types: one using a bulk-state piezoelectric body and the other using a thin film piezoelectric body (piezoelectric thin film). The former type has a large output enough to eject large ink droplets, but unfortunately, this type is large-sized and thus is high in cost. In contrast, the latter type has a small output and thus is not capable of increasing the amount of droplet, but is compact and thus is low in cost. It is, therefore, reasonable to consider that forming an actuator with a piezoelectric thin film is suitable to achieve compact and high-resolution printers (small ink droplets would be allowable) at low cost. Note that whether to use the piezoelectric thin film or the bulk-state piezoelectric body on a piezoelectric actuator may be selected according to usage. It is possible to selectively use bulk-state piezoelectric body or thin-film type according to the print image size, the print speed, the equipment size, or the like.

FIG. 18A is a plan view illustrating a schematic configuration of a known inkjet head 100 using a piezoelectric actuator. FIG. 18B is a cross-sectional view taken along line D-D' in the plan view. FIG. 18C is cross-sectional view taken along line E-E' in the cross-sectional view. For the reason of convenience, illustrations of a lower electrode 201 and an upper electrode 203 of a drive element 104 described below are omitted in the plan view. The inkjet head 100 is configured such that a support substrate 101 including a plurality of pressure chambers 101*a* is sandwiched between a vibration plate 102 and a nozzle plate 103, and a drive element 104 including a piezoelectric body is formed on the vibration plate 102 above each of the pressure chambers 101*a*. The nozzle plate 103 includes a nozzle hole 103*a* to eject ink inside each of the pressure chambers 101*a* to the outside.

In addition to the plurality of pressure chambers 101*a*, two ink flow paths 101*b* are arranged in parallel on the support substrate 101. The plurality of pressure chambers 101*a* is formed in zigzag in two rows between the two ink flow paths 101*b*, 101*b*. The pressure chamber 101*a* in one row communicates with one ink flow path 101*b* via a communication passage 101*c* (ink stop), the pressure chamber 101*a* in the other row communicates with the other ink flow path 101*b* via another communication passage 101*c*. Moreover, one end of each of the ink flow paths 101*b* communicates with an ink container (ink storage tank) (not illustrated) via an ink supply port 105, while the other end communicates with the ink container via an ink discharge port 106.

The recording medium such as a sheet and a cloth moves relatively in the up-down direction of the sheet surface in the plan view in FIG. 18A. For a given constant moving speed of the recording medium, the resolution in the up-down direction is determined by the amount of droplet and the drive frequency of the channel, and the resolution in the left-right direction is determined by the amount of droplet and a channel pitch (p). In order to achieve high-resolution drawing, reduction of the channel pitch would be needed. On the other hand, in order to achieve a desired amount of droplet, a constant area for the pressure chamber (size of the pressure chamber) would be needed. In order to cope with this spatial incompatibility therebetween, there is a technique of providing a multiple rows of channels in the up-down direction so as to reduce an apparent pitch.

In order to allow the inkjet head 100 to achieve printing machine-quality high resolution as high as about 600 dpi to 2400 dpi (dot per inch), several to several tens of rows would be needed. Increasing the number of rows, however, would also increase the head area. An enlarged head would increase the size and cost of the apparatus, and in addition, image quality would be deteriorated due to speed variation within a row or misalignment between the head and the recording medium.

In order to eliminate this inconvenience, there is a need to arrange the channels with a predetermined size in high density. To achieve high-density arrangement of the channels, it would be desirable to use flexible arrangement in which the directions of the channels (herein, corresponds to a direction from the ink flow path 101*b* to the pressure chambers 101*a*) are alternated, as illustrated in FIG. 18C.

Next, channels of the known inkjet head 100 will be described in detail. FIG. 19A is a plan view of one channel of the inkjet head 100. FIG. 19B is a cross-sectional view taken along line F-F' in the plan view. The drive element 104 is formed on the vibration plate 102 via an insulating layer 107. The drive element 104 is formed with the lower electrode 201, a piezoelectric body 202, and the upper electrode 203 stacked in the order from the vibration plate 102 side. The lower electrode 201 is an electrode shared by all the drive elements 104. The upper electrode 203 is separately connected with wiring unit 301 via a lead-out unit 301*a* having a small width. The lead-out unit 301*a* and the wiring unit 301 are formed on the piezoelectric body 202 drawn from above the pressure chambers 101*a* along the lower electrode 201. The lower electrode 201 and the wiring unit 301 are electrically connected with a drive circuit 108 via electrical wiring.

When voltage is applied from the drive circuit 108 to the lower electrode 201 and the upper electrode 203, the piezoelectric body 202 is stretched in a direction perpendicular to the thickness direction. Subsequently, the difference in length between the piezoelectric body 202 and the vibration plate 102 generates curvature on the vibration plate 102, leading to the occurrence of displacement (curve) of the vibration plate 102 in the thickness direction. The displacement of the vibration plate 102 gives pressure to the inside of the pressure chambers 101*a*, thereby ejecting the ink inside the pressure chambers 101*a* to the outside as droplets via the nozzle hole 103*a*. Hereinafter, note that, the vibration plate 102, the insulating layer 107, and the drive element 104, located above the pressure chambers 101*a*, will be collectively referred to as an actuator 110.

As the piezoelectric body 202 used for the drive element 104, perovskite-type metal oxide such as barium titanate ($BaTiO_3$) and lead zirconate titanate ($Pb(Ti/Zr)O_3$) referred to as PZT is widely used. For constituting a piezoelectric body using a piezoelectric thin film, PZT is formed on the substrate, for example, by deposition. Deposition of the PZT can be performed by various techniques including sputtering, a chemical vapor deposition (CVD) method, and a sol-gel method. Note that crystallization of piezoelectric materials needs high temperature, and therefore, silicon (Si) is often used as the substrate. In the case of using the bulk-state piezoelectric body separately produced by a firing method, it would be allowable to fix this piezoelectric body onto the substrate using bonding or screwing.

Meanwhile, the support substrate 101 beneath the lead-out unit 301*a* includes a recess (opening) 101*d* having a width smaller than the width of the pressure chambers 101*a*. This is due to the following reason. That is, since the piezoelectric body 202 and the lower electrode 201 exist beneath the lead-out unit 301*a*, the piezoelectric body 202 sandwiched therebetween is stretched when voltage is applied to the lead-out unit 301*a* and the lower electrode 201. Under this situation, in a case where the recess 101*d* is not formed on the support substrate 101, the vibration plate 102 located between the lead-out unit 301*a* and the support substrate 101 would not substantially be deformed (vibrated) when the voltage is applied Accordingly, stress might be concentrated onto the small-width lead-out unit 301*a* and the piezoelectric body 202 existing beneath (in particular, around a boundary with the pressure chambers 101*a*), and thus, might damage the piezoelectric body 202 and the lead-out unit 301*a*. By providing the recess 101*d* beneath the lead-out unit 301*a* of the support substrate 101, however, the vibration plate 102 on the recess 101*d* would be deformed when voltage is applied, making it possible to disperse the stress applied to the lead-out unit 301*a* and to prevent damage on the lead-out unit 301*a*. The configuration that includes a recess (sub-chamber, buffer chamber) on the substrate beneath the lead-out unit 301*a* in order to prevent the damage on the lead-out unit 301*a* is also disclosed in Patent Literature 1, for example.

Note that, hereinafter, the pressure chambers 101*a* and the recess 101*d* will collectively be referred to as a pressure chamber P, for the reason of convenience. In this case, the pressure chamber P can be considered to have a rotationally asymmetric shape on a plan view (viewed from actuator 110 side) as illustrated in the plan view in FIG. 19A. Moreover, hereinafter, a direction from the pressure chambers 101*a* toward the recess 101*d* will be referred to as a direction of the pressure chamber P.

Meanwhile, the actuator 110 and the pressure chamber P are individually processed with a photoengraving (photolithography) technique. Since this technique uses a mask processed in high accuracy, misalignment would not easily occur in processing on a same surface. However, since the actuator 110 and the pressure chamber P are formed by processing from mutually opposite sides with respect to the support substrate 101, it would be difficult to form the both with a same step. Accordingly, they need to be formed in separate steps. Front and rear sides of a substrate normally have reference marks. In a case where different surfaces of the substrate are going to be processed, alignment is ordinarily performed by visually checking both marks. However, since the substrate (e.g., silicon substrate) is opaque, the substrate needs to be processed while images viewed from individual front and rear surfaces of the substrate are aligned. This processing tends to induce misalignment.

When the actuator 110 is located on the pressure chamber P having a rotationally asymmetric shape in a plan view, planar misalignment possibly occurring between the pressure chamber P and the actuator 110 might lead to a problem of ink ejection characteristic (injection performance) variation attributed to the misalignment.

FIG. 20 schematically illustrates a positional relationship of the actuator 110 with respect to the pressure chamber P having a rotationally asymmetric shape in plan view. In the diagram, the directions of the pressure chambers P are different between in upper-row channels (channels in (2) (4)) and in lower-row channels (channels in (1) (3)) so as to arrange the channels in high density. In the diagram, with two directions perpendicular to each other within a plane parallel to the support substrate 101 being defined as an X-direction and a Y-direction, pattern 1 illustrates a case where the actuator 110 has no misalignment with respect to the pressure chamber P, and patterns 2 to 4 respectively illustrate cases where the actuator 110 is misaligned in the Y-direction, X-direction, and both X- and Y-directions with respect to the pressure chamber P.

In pattern 2, the actuator 110 is close to a portion with no recess (pressure chamber P) on the support substrate 101 in plan view, on the lower-row channels. The portion with no recess on the support substrate 101 has high rigidity. Therefore, even when the piezoelectric body 202 of the actuator 110 is stretched rightward and leftward (in direction parallel to substrate) at driving, the vibration plate 102 is not easily deformed in a direction perpendicular to the substrate. In this case, since displacement of the vibration plate 102 is reduced, the pressure transmitted to the ink inside the pressure chamber P is decreased, leading to the decrease in injection speed and the amount of droplet. Meanwhile, the actuator 110 is misaligned in the Y-direction also in the upper-row; channels. However, since there is the recess 101*d* as a buffer chamber of the pressure chamber P, rigidity is low and displacement of the vibration plate 102 would not be reduced so much.

In pattern 3, the actuators 110 in all channels are misaligned in the X-direction. Accordingly, similarly to the lower-row of pattern 2, displacement of the vibration plate 102 is reduced in all the channels.

Displacement reduction of the vibration plate 102 in pattern 4 corresponds to a combination of patterns 2 and 3. The displacement reduction of the vibration plate 102 is greater in the lower-row channels rather than in the upper-row channels.

The recording medium such as a sheet and a cloth moves relatively in the Y-direction in FIG. 20, with respect to the head, for example. In examples in patterns 2 and 4, ejection performance deterioration is greater in the lower-row channels rather than in the upper-row; channels. As a result, streaky gradation unevenness is generated on the recording medium.

Note that, in a case where ejection performance changes evenly across all channels as in pattern 3, it is possible to manage this issue by uniformly adjusting drive circuit output. Unfortunately, however, since almost all cases like patterns 2 and 4 include misalignment in the Y-direction of relative movement of the recording medium, uniform adjustment for all the channels cannot handle the problem.

In this manner, forming the pressure chamber P and the actuator 110 with different steps onto the front-back of the substrate would generate a difference in output due to misalignment at processing, and image quality deterioration caused by this difference.

In this regard, Patent Literatures 2 to 4 disclose, for example, a technique of correcting image gradation by adjusting drive signals in accordance with the magnitude of ejection performance with independent amplifiers, resistors, and correction memories, provided for individual channels. These techniques, however, need to arrange elements for individual channels, leading to an increase in cost and the head size.

Meanwhile, there is a technique, similar to the above-described technique, of controlling the amount of ink ejection for individual channel rows. For example, Patent Literatures 5 and 6 describe a technique to suppress, on the head including a plurality of rows of channels, image quality deterioration with uneven density by controlling the amount of injection for the individual rows. Moreover, Patent Literature 7 describe a technique to suppress image deterioration induced by uneven temperature, by arranging a functional circuit configured to control constant current drive of individual switching elements, on a head configured to eject ink by performing constant current drive of a plurality of heaters arranged in the row direction, using individual switching elements.

CITATION LIST

Patent Literature

Patent Literature 1: JP 4935965 B (refer to claim 1, paragraphs [0008], [0022], [0033], [0055], FIG. 1, or the like)

Patent Literature 2: JP 2013-46988 A (refer to claim 1, paragraphs [0010], [0013], [0028], [0034], [0052], FIG. 4, or the like)

Patent Literature 3: JP 2009-196197 A (refer to claim 1, paragraphs [0005], [0028], [0029], FIG. 5, or the like)

Patent Literature 4: JP 3-140252 A (refer to claims)

Patent Literature 5: JP 2012-6239 A (refer to claim 1, paragraphs [0007], [0048], [0052], FIGS. 8 to 10, or the like)

Patent Literature 6: JP 2010-76276 A (refer to claim 1, paragraphs [0007], [0014], or the like)

Patent Literature 7: JP 2010-131862 A (refer to claim 1, paragraphs [0027] to [0031], [0035], or the like)

SUMMARY OF INVENTION

Technical Problem

In a case, as Patent Literature 5 to 7, where the amount of ink ejection is to be controlled for individual rows by a control circuit, however, it would be necessary to arrange channels in a same row such that pressure chambers face a same direction in order to facilitate wiring arrangement between the control circuit and the channels. In order to achieve high-density channel arrangement, there is a need to arrange channels including the pressure chambers facing different directions as described above. However, when individual channels are arranged in a same direction in a same row as describe above, the channel having a pressure chamber facing different direction from the case of the channel is inevitably arranged in a row different from the row. This leads to a concern of an enlarged head size due to the increase in the number of rows in an attempt to achieve desired resolution.

The present invention has been made to solve the above-described issue, and an object thereof is to provide an inkjet head capable of achieving, with a compact configuration, high-density arrangement of a plurality of channels including pressure chambers facing different directions and high resolution as a result of this arrangement, and suppressing image quality deterioration generated by misalignment between the actuator and the pressure chamber, a method for manufacturing the inkjet head, and an inkjet printer equipped with the inkjet head.

Solution to Problem

An inkjet head according to one aspect of the present invention is an inkjet head including a plurality of channels configured to eject ink from a pressure chamber by the drive of an actuator, in which the pressure chamber in each of the channels has a non-rotating body shape with respect to an axis perpendicular to a substrate on which the pressure chamber is formed, and when a direction corresponding to a rotation angle of the pressure chamber from a reference position around the axis passing through the pressure chamber is defined as a direction of the pressure chamber, the plurality of channels arranged in a same row in a direction parallel to the substrate includes channels having the pressure chambers facing different directions, and the channels driven by a same circuit element in the same row are arranged such that the pressure chambers face a same direction.

The inkjet head according to another aspect of the present invention is an inkjet head including a plurality of channels configured to eject ink from a pressure chamber by the drive of an actuator, in which the pressure chamber in each of the channels has a non-rotating body shape with respect to an axis perpendicular to a substrate on which the pressure chamber is formed, and when a direction corresponding to a rotation angle of the pressure chamber from a reference position around the axis passing through the pressure chamber is defined as a direction of the pressure chamber, the plurality of channels arranged in a same row in a direction parallel to the substrate includes channels having the pressure chambers facing different directions, and channels driven by a drive signal having a same drive waveform at ink ejection in the same row are arranged such that the pressure chambers face a same direction.

Advantageous Effects of Invention

According to the above-described configuration, the plurality of channels arranged in the same row includes channels including the pressure chambers facing different directions, it is possible to achieve high-density arrangement of the channels and high resolution, with a configuration with a small head. Moreover, since the channels driven by the same circuit element or by the drive signal having the same drive waveform at ink ejection are arranged, in the same row, such that the pressure chambers face a same direction, it is possible, in the same row, to drive the channels having the pressure chambers facing different directions by different circuit elements or different drive signals. With this configuration, it is possible to suppress image quality deterioration generated by misalignment between the actuator and the pressure chamber.

DESCRIPTION OF EMBODIMENTS

An embodiment of the present invention will be described below with reference to the drawings.

[Configuration of Inkjet Printer]

Figure 1:
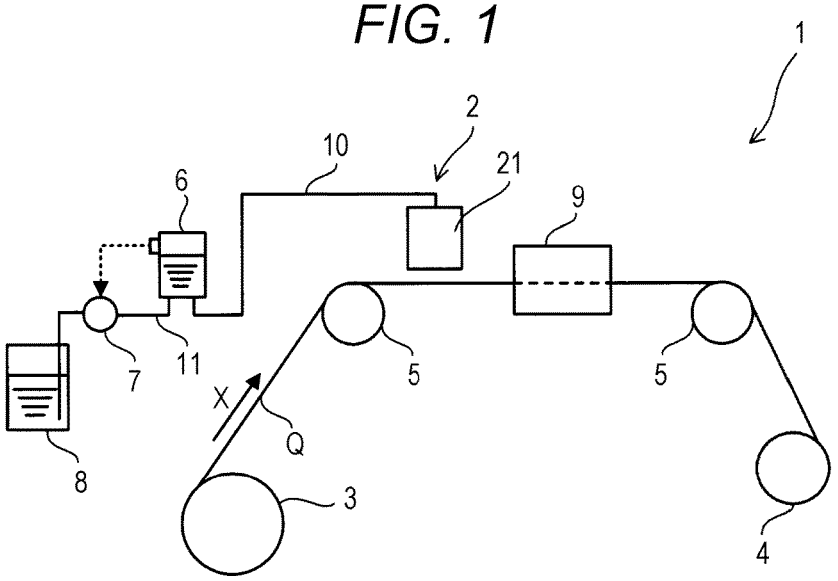
FIG. 1 is a diagram illustrating a schematic configuration of an inkjet printer according to an embodiment of the present invention.

FIG. 1 is a diagram illustrating a schematic configuration of an inkjet printer 1 according to the present embodiment. The inkjet printer 1 is a line-head system inkjet recording apparatus in which an inkjet head 21 is provided on an inkjet head unit 2 as a line in a width direction of a recording medium.

The inkjet printer 1 includes the inkjet head unit 2, a feed role 3, a wind-up role 4, two back rolls 5, 5, an intermediate tank 6, a liquid-feed pump 7, a storage tank 8, and a fixing mechanism 9.

The inkjet head unit 2 ejects ink from the inkjet head 21 toward a recording medium Q, thereby performing image formation (drawing) based on image data. The inkjet head unit 2 is arranged in the vicinity of the back role 5. The configuration of the inkjet head 21 will be described below.

The feed role 3, the wind-up role 4 and each of the back roles 5 are cylindrical-shaped members rotatable around individual axes. The feed role 3 is a roll configured to feed the long recording medium Q wound on a circumference multiple times, toward a position facing the inkjet head unit 2. The feed role 3 rotates by a drive unit (not illustrated) such as a motor, thereby feeding and conveying the recording medium Q in the X-direction in FIG. 1.

The wind-up role 4 winds up, onto its circumference, the recording medium Q that was fed by the feed role 3 and received ink ejected by the inkjet head unit 2.

Each of the back roles 5 is disposed between the feed role 3 and the wind-up role 4. One of the back rolls 5 located on an upstream side of the recording medium Q in a conveyance direction conveys the recording medium Q fed by the feed role 3 toward the position facing the inkjet head unit 2, while supporting the recording medium Q by winding the recording medium Q onto a portion of the circumference. The other back role 5 conveys the recording medium Q while supporting the recording medium Q by winding the recording medium Q onto a portion of the circumference, from the position facing the inkjet head unit 2 toward the wind-up role 4.

The intermediate tank 6 temporarily stores the ink supplied from the storage tank 8. Moreover, the intermediate tank 6 is connected with an ink tube 10, adjusts a back pressure of the ink in the inkjet head 21, and supplies the ink to the individual inkjet head 21.

The liquid-feed pump 7 is configured to supply the ink stored the storage tank 8 to the intermediate tank 6, and disposed halfway on a supply pipe 11. The ink stored in the storage tank 8 is pumped up by the liquid-feed pump 7 and supplied to the intermediate tank 6 via the supply pipe 11.

The fixing mechanism 9 fixes the ink ejected onto the recording medium Q by the inkjet head unit 2, on the recording medium Q. The fixing mechanism 9 includes a heater for heating and fixing the ejected ink onto the recording medium Q, a UV lamp for curing the ink by emitting ultraviolet (UV) light on the ejected ink.

In the above-described configuration, the recording medium Q fed by the feed role 3 is conveyed, by the back role 5, to a position facing the inkjet head unit 2 and then, ink is ejected from the inkjet head unit 2 toward the recording medium Q. Thereafter, the ink ejected on the recording medium Q is fixed by the fixing mechanism 9 and the recording medium Q after ink fixation is wound up by the wind-up role 4. In this manner, the line-head system inkjet printer 1 is configured to eject the ink in a state where the inkjet head unit 2 is stationary, while the recording medium Q is conveyed, and then, an image is formed on the recording medium Q.

Note that the inkjet printer 1 may be configured to form an image on the recording medium using a serial-head system. The serial-head system is a system of forming an image by conveying a recording material and simultaneously ejecting ink by moving the inkjet head in a direction (width direction) orthogonal to the direction of conveying the recording medium. In this case, the inkjet head moves in the width direction of the recording medium while being supported by a structure body such as a carriage.

[Configuration of Inkjet Head]

Figure 2:
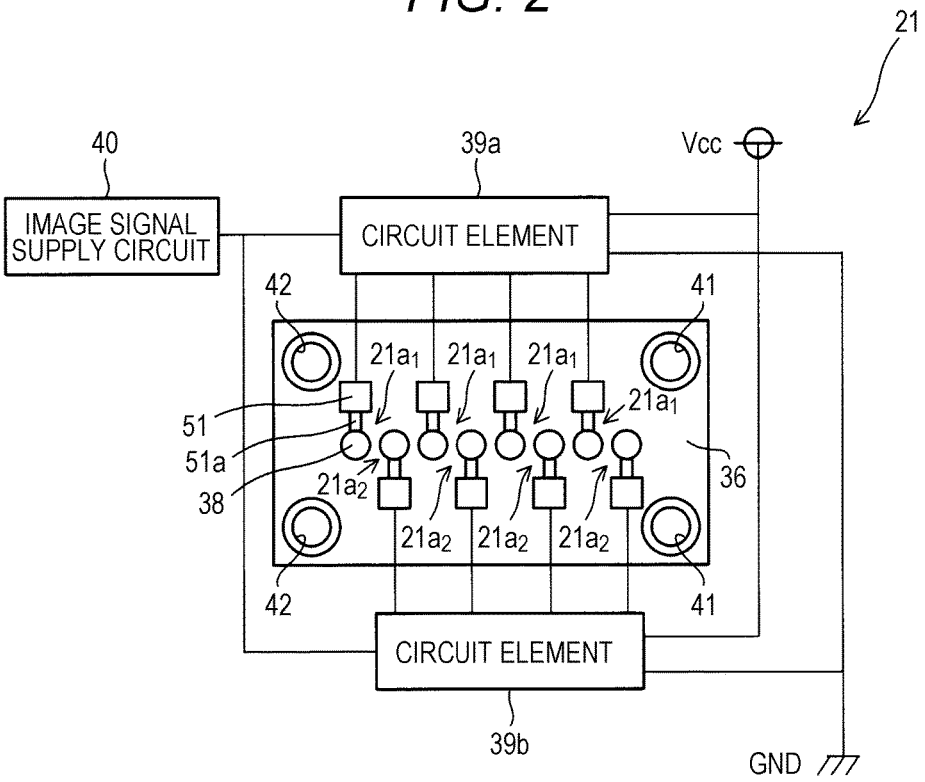
FIG. 2 is a diagram illustrating an entire configuration of an inkjet head included in the inkjet printer.
Figure 3:
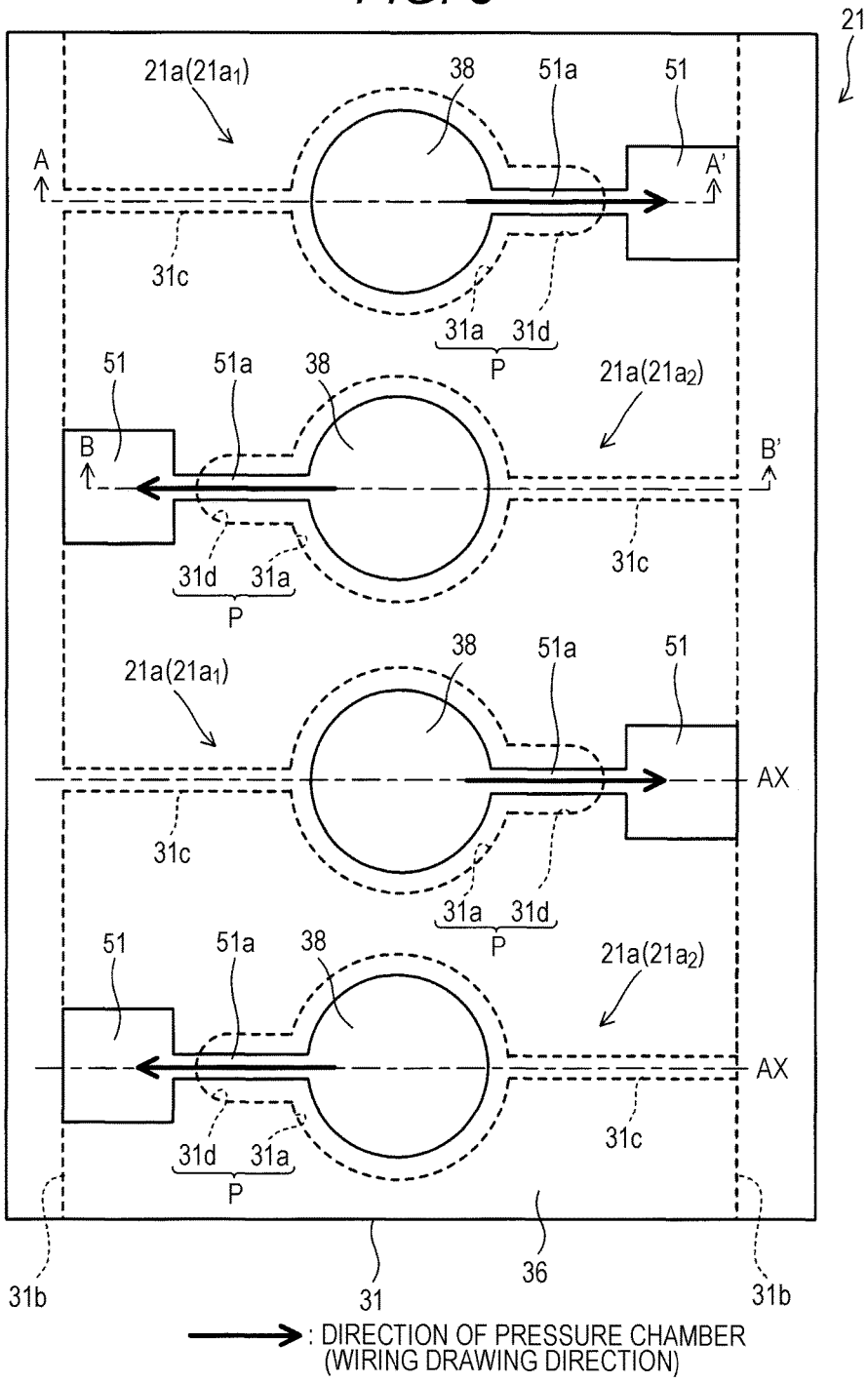
FIG. 3 is a plan view illustrating an enlarged partial configuration of the inkjet head.
Figure 4:
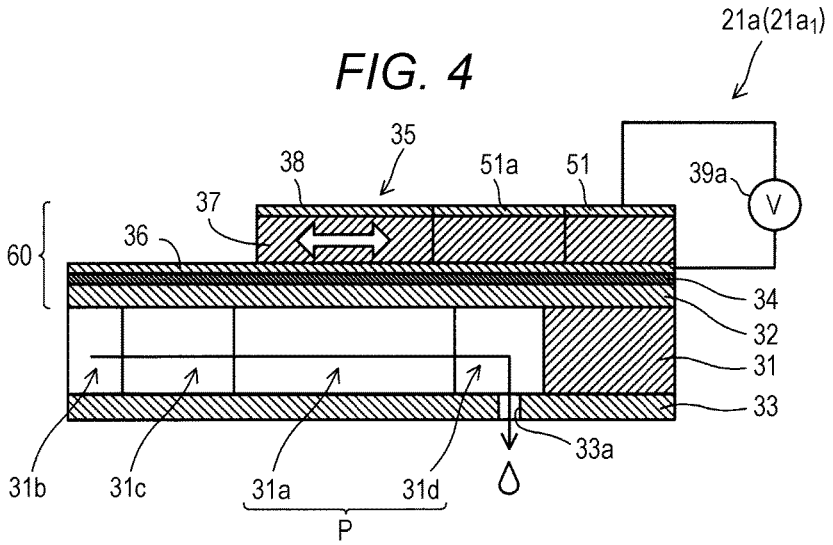
FIG. 4 is a cross-sectional view taken along line A-A' in FIG. 3.
Figure 5:
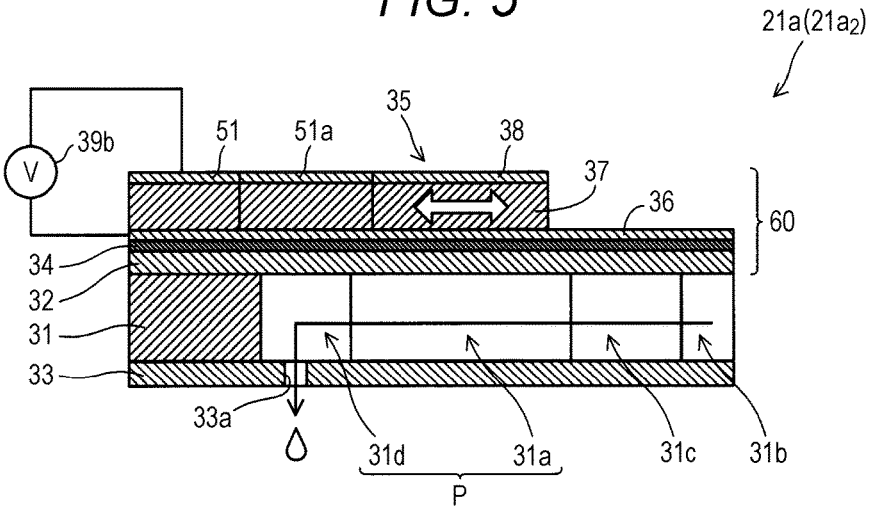
FIG. 5 is a cross-sectional view taken along line B-B' in FIG. 3.

Next, the configuration of the inkjet head 21 will be described. FIG. 2 is a diagram illustrating an entire configuration of the inkjet head 21. FIG. 3 is a plan view illustrating an enlarged partial configuration of the inkjet head 21. FIG. 4 is a cross-sectional view taken along line A-A' in FIG. 3. FIG. 5 is a cross-sectional view taken along line B-B' in FIG. 3.

As illustrated in FIGS. 4 and 5, the inkjet head 21 according to the present embodiment includes a plurality of channels 21*a* (ink ejectors) configured to eject ink from the pressure chamber P by an actuator 60 located above the pressure chamber P. The inkjet head 21 configured like this has a support substrate 31 being sandwiched between a vibration plate 32 and a nozzle plate 33, having a fixed thickness. The support substrate 31 includes a plurality of pressure chambers P. The nozzle plate 33 includes a nozzle hole 33*a* corresponding to each of the pressure chambers P.

The pressure chamber P includes a main-chamber 31*a* and a sub-chamber 31*d* smaller in capacity than the main-chamber 31*a*. The main-chamber 31*a* is a chamber driven mainly by the actuator 60. Pressure is applied to the inside of the main-chamber 31*a* by the actuator 60, making it possible to eject the ink inside the main-chamber 31*a* to outside. On the support substrate 31, the sub-chamber 31*d* is provided beneath a lead-out unit 51*a* described below and communicates with the main-chamber 31*a*. By providing the sub-chamber 31*d* on the support substrate 31, it is possible to disperse the stress applied to the lead-out unit 51*a* at application of the drive voltage onto the actuator 60, and thus to prevent damage on the lead-out unit 51*a*.

Herein, a direction in the pressure chamber P from the main-chamber 31*a* toward the sub-chamber 31*d* is defined as the direction of the pressure chamber P. In the present embodiment, the plurality of channels 21*a* is arranged in a same row. In addition, the plurality of channels 21*a* in the same row includes channels $\mathbf{21}a_1$ and $\mathbf{21}a_2$ having the pressure chambers P facing mutually different directions. While the present embodiment assumes that the directions of the pressure chamber P are opposite directions (180° different) in the channel $\mathbf{21}a_1$ and the channel $\mathbf{21}a_2$, the direction is not limited to this completely opposite directions. For example, the channel $\mathbf{21}a_1$ and $\mathbf{21}a_2$ may be arranged in a same row such that the pressure chambers P face the directions of intersecting with an angle smaller than 180°.

In addition to the plurality of pressure chambers P, two ink flow paths 31*b* are arranged in parallel (refer to FIG. 3) on the support substrate 31. The plurality of pressure chambers P is arranged between the two ink flow paths 31*b*, 31*b*, on the support substrate 31. Each of the pressure chambers P communicates with one of the two ink flow paths 31*b* via a communication passage 31*c* located on the opposite side of the sub-chamber 31*d*, with respect to the main-chamber 31*a*. One end of each of the ink flow paths 31*b* communicates with an ink container (ink storage tank) via an ink supply port 41 (refer to FIG. 2), while the other end communicates with the ink container via an ink discharge port 42.

A drive element 35 is formed, via an insulating layer 34, on the vibration plate 32 above each of the pressure chambers P. The actuator 60 includes at least the vibration plate 32 and the drive element 35, located above the pressure chamber P. The drive element 35 is formed with a lower electrode 36, a piezoelectric thin film 37, and an upper electrode 38 stacked in this order from the vibration plate 32 side. The piezoelectric thin film 37 has a thickness of 1 μm to 10 μm, to be a thin-film piezoelectric body. The lower electrode 36 is an electrode shared by all the drive elements 35. The upper electrode 38 is separately connected with wiring unit 51 via a lead-out unit 51*a* having a small width. The lead-out unit 51*a* and the wiring unit 51 are formed on the piezoelectric thin film 37 drawn from above the main-chamber 31*a* of the pressure chamber P along the lower electrode 36.

Each of the lower electrode 36 and the upper electrode 38 is connected with one of circuit elements 39*a* and 39*b* via electric wiring. The circuit elements 39*a* and 39*b* are drive circuits configured to supply drive voltage (drive signal) to the lower electrode 36 and the upper electrode 38. More specifically, the lower electrode 36 and the upper electrode 38 of the channel $\mathbf{21}a_1$ are connected with the circuit element 39*a*, while the lower electrode 36 and the upper electrode 38 of the channel $\mathbf{21}a_2$ are connected with the circuit element 39*b*.

The circuit elements 39*a* and 39*b* convert voltage supplied from a power supply Vcc into predetermined drive voltage, and applies the drive voltage to the upper electrode 38 (the lower electrode 36 is grounded, for example) in synchronization with the image signal supplied from an image signal supply circuit 40. This configuration enables control of ink ejection in accordance with the pattern to be printed. Note that the image signal supply circuit 40 may be mounted on the head or may be provided outside the head.

When the ink is introduced into the ink flow path 31*b* from the ink supply port 41, the ink is supplied to the inside of each of the pressure chambers P via the communication passage 31*c*. The ink inside each of the pressure chambers P is ejected to the outside by vibrating the vibration plate 32 by the drive element 35. More specifically, when drive voltage is applied from the circuit elements 39*a* and 39*b* to the lower electrode 36 and the upper electrode 38 respectively, the piezoelectric thin film 37 is stretched in a direction perpendicular to the thickness direction. Subsequently, the difference in length between the piezoelectric thin film 37 and the vibration plate 32 generates curvature on the vibration plate 32, leading to the occurrence of displacement (curve) on the vibration plate 32 in the thickness direction. The displacement of the vibration plate 32 gives pressure to the inside of the pressure chamber P (main-chamber 31*a*), thereby ejecting the ink inside the pressure chamber P to the outside as droplets via the nozzle hole 33*a*.

In the configuration in the present embodiment, in which the support substrate 31 includes the pressure chamber P (the main-chamber 31*a* and the sub-chamber 31*d*), each of the pressure chambers P has a rotationally asymmetric shape in plan view, as illustrated in FIG. 3. That is on each of the channels 21*a*, the pressure chamber P has a linearly symmetric shape with solely one symmetric axis, viewed from the actuator 60 side. The symmetric axis corresponds to drive signal supply wiring drawn from the actuator 60, that is, an axis AX along a drawing direction (solid arrow direction in FIG. 3) of the lead-out unit 51*a* of the upper electrode 38.

[Method for Manufacturing Inkjet Head]

Figure 6:
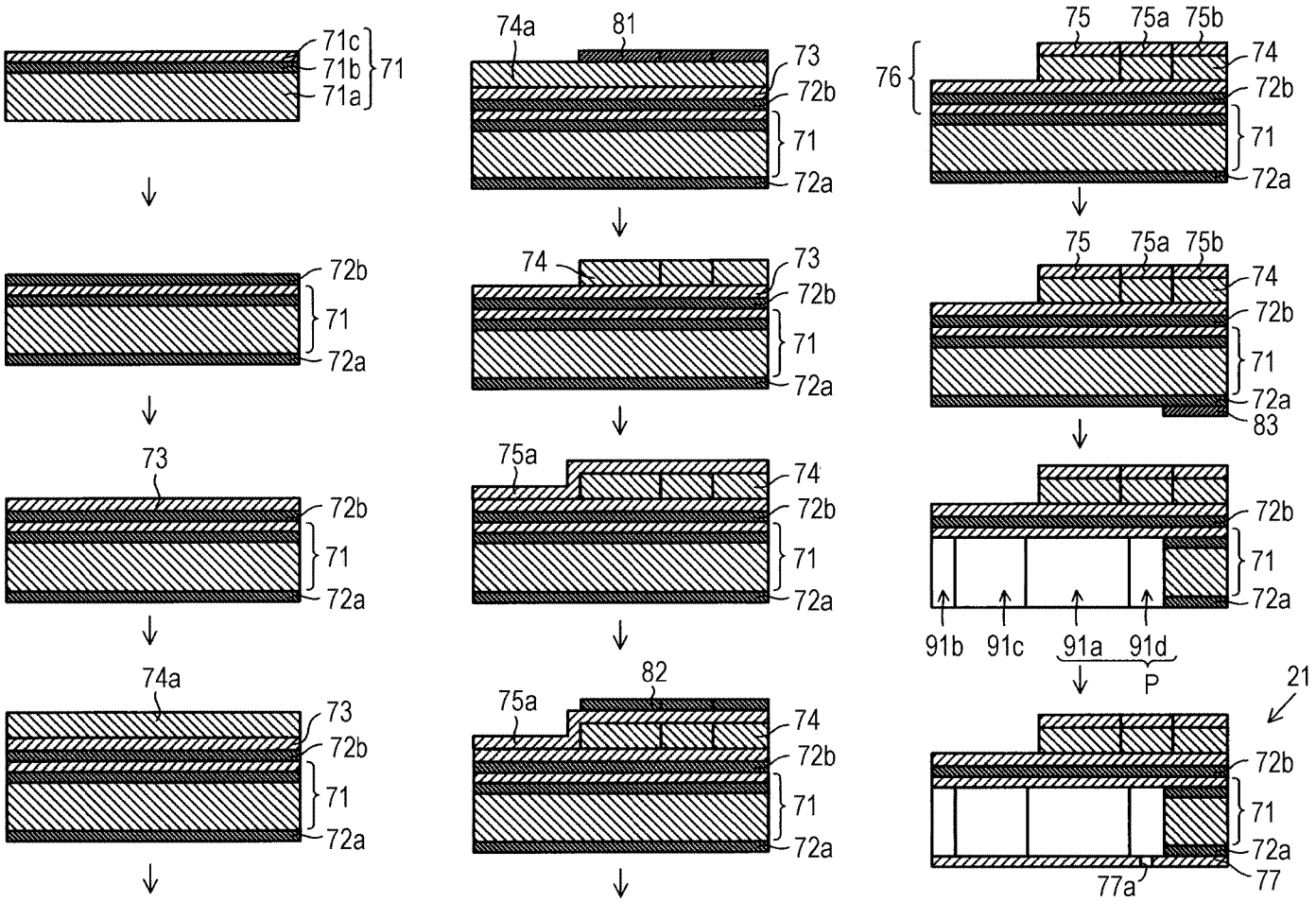
FIG. 6 is a cross-sectional view illustrating manufacturing steps of the inkjet head.

Next, a method for manufacturing the inkjet head 21 will be described. FIG. 6 is a cross-sectional view illustrating manufacturing steps of the inkjet head 21.

First, a substrate 71 is prepared. As the substrate 71, it is possible to use crystalline silicon (Si) widely used in the microelectromechanical systems (MEMS). Herein, a SOI structure bonding two Si substrates 71*a* and 71*c* via an oxide film 71*b* is used. The substrate 71 has a thickness defined in a standard, or the like. For example, in a case where a 6-inch type is used, the substrate 71 has a thickness of approximately 600 μm.

The substrate 71 is put in a heating furnace and maintained to a temperature at approximately 1500° C. for a predetermined time so as to form thermal oxide films 72*a* and 72*b* formed of $SiO_2$ on surfaces of the Si substrates 71*a* and 71*c*, respectively. Next, layers of titanium and platinum are deposited sequentially on one thermal oxide film 72*b* by sputtering, so as to form a lower electrode 73.

Subsequently, the substrate 71 is re-heated to approximately 600° C. so as to deposit a layer 74*a* of a piezoelectric body formed of PZT, for example, by sputtering. Next, photosensitive resin 81 is applied on the layer 74*a* by spin coating, and exposure and etching are performed via a mask so as to remove unnecessary portion from the photosensitive resin 81, and a shape of piezoelectric thin film 74 to be formed is transferred. Thereafter, the shape of the layer 74*a* is processed using reactive ion etching using the photosensitive resin 81 as a mask, to form the piezoelectric thin film 74.

Next, layers of titanium and platinum are deposited sequentially by sputtering to forma layer 75*a* on the lower electrode 73 so as to cover the piezoelectric thin film 74. Subsequently, photosensitive resin 82 is applied on the layer 75*a* by spin coating, and exposure and etching are performed via a mask so as to remove unnecessary portion from the photosensitive resin 82, and shapes of an upper electrode 75, a lead-out unit 75*a*, and a wiring unit 75*b*, to be formed, are transferred. Thereafter, the shape of the layer 75*a* is processed using reactive ion etching using the photosensitive resin 82 as a mask, to form, on the piezoelectric thin film 74, the upper electrode 75, the lead-out unit 75*a*, and the wiring unit 75*b*. This processing forms an actuator 76.

Next, photosensitive resin 83 is applied on a back surface of the substrate 71 (thermal oxide film 72*a* side) by spin coating, and exposure and etching are performed via a mask so as to remove unnecessary portion from the photosensitive resin 83, and shapes of the pressure chamber P (main-chamber 91*a*, sub-chamber 91*d*), an ink flow path 91*b*, and a communication passage 71*c*, to be formed, are transferred. Subsequently, removal processing for the substrate 71 is performed using the photosensitive resin 83 as a mask, by reactive ion etching, so as to form the pressure chamber P, or the like.

Thereafter, the substrate 71 is bonded with a nozzle plate 77 including a nozzle hole 77*a*, using adhesive, or the like. This processing completes the inkjet head 21. Note that it would be also allowable to use intermediate glass having a through hole at a position corresponding to the nozzle hole 77*a*, remove the thermal oxide film 72*a*, and perform anodic bonding between the substrate 71 and the intermediate glass, and between the intermediate glass and the nozzle plate 77. In this case, it is possible to bond the three components (substrate 71, intermediate glass, and nozzle plate 77) together without using adhesive.

Note that the Si substrate 71*a* and the oxide film 71*b* in FIG. 6 correspond to the support substrate 31 in FIG. 4, and the Si substrate 71*c* corresponds to the vibration plate 32, respectively. Moreover, the nozzle plate 77 corresponds to the nozzle plate 33. Each of the lower electrode 73, the piezoelectric thin film 74, the upper electrode 75, the lead-out unit 75*a*, the wiring unit 75*b*, and an actuator 76 corresponds to each of the lower electrode 36, the piezoelectric thin film 37, the upper electrode 38, the lead-out unit 51*a*, the wiring unit 51, and the actuator 60, respectively. Moreover, each of the main-chamber 91*a*, the ink flow path 91*b*, the communication passage 91*c*, and the sub-chamber 91*d* corresponds to each of the main-chamber 31*a*, the ink flow path 31*b*, the communication passage 31*c*, and the sub-chamber 31*d*, respectively.

Figure 20:
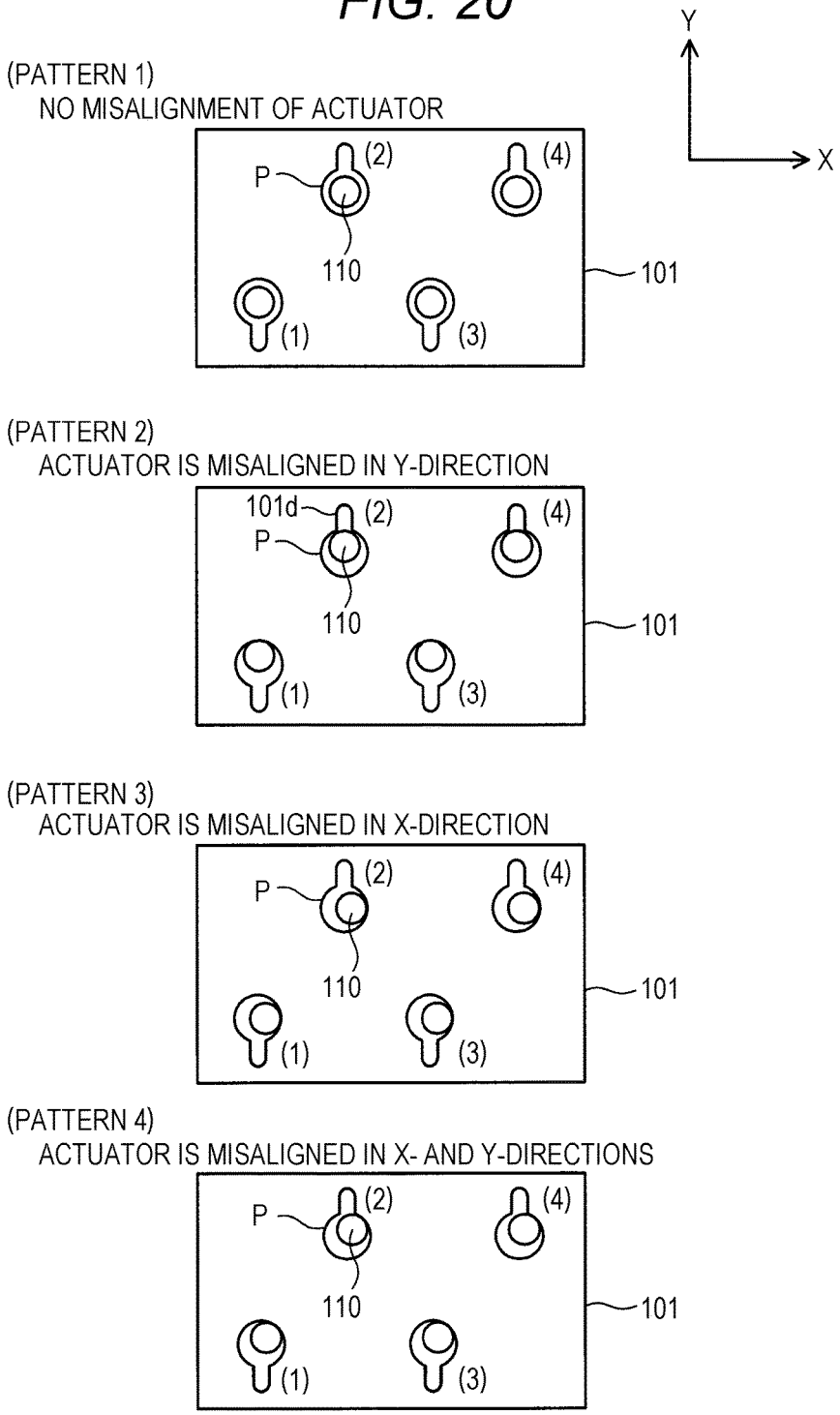
FIG. 20 is a diagram schematically illustrating a positional relationship of the actuator with respect to the pressure chamber having a rotationally asymmetric shape in plan view.

As described above, when the inkjet head 21 is manufactured, the pressure chamber P is formed on one surface side of the substrate 71, and the actuator 76 is formed by processing from other surface side of the substrate 71. This makes it difficult to form the pressure chamber P and the actuator 76 in a same step, and thus, they are configured to be formed indifferent steps. In this case, a planar misalignment might easily occur between the pressure chamber P and the actuator 76. Moreover, in a configuration to have channels having the pressure chambers P facing different directions, the ink ejection characteristic would vary between channels having the pressure chambers P facing different directions as described above when the misalignment is generated (refer to FIG. 20). Accordingly, variation in ink ejection characteristic is corrected in the present embodiment as below.

[Correcting Ink Ejection Characteristic Variation]

Figure 7:
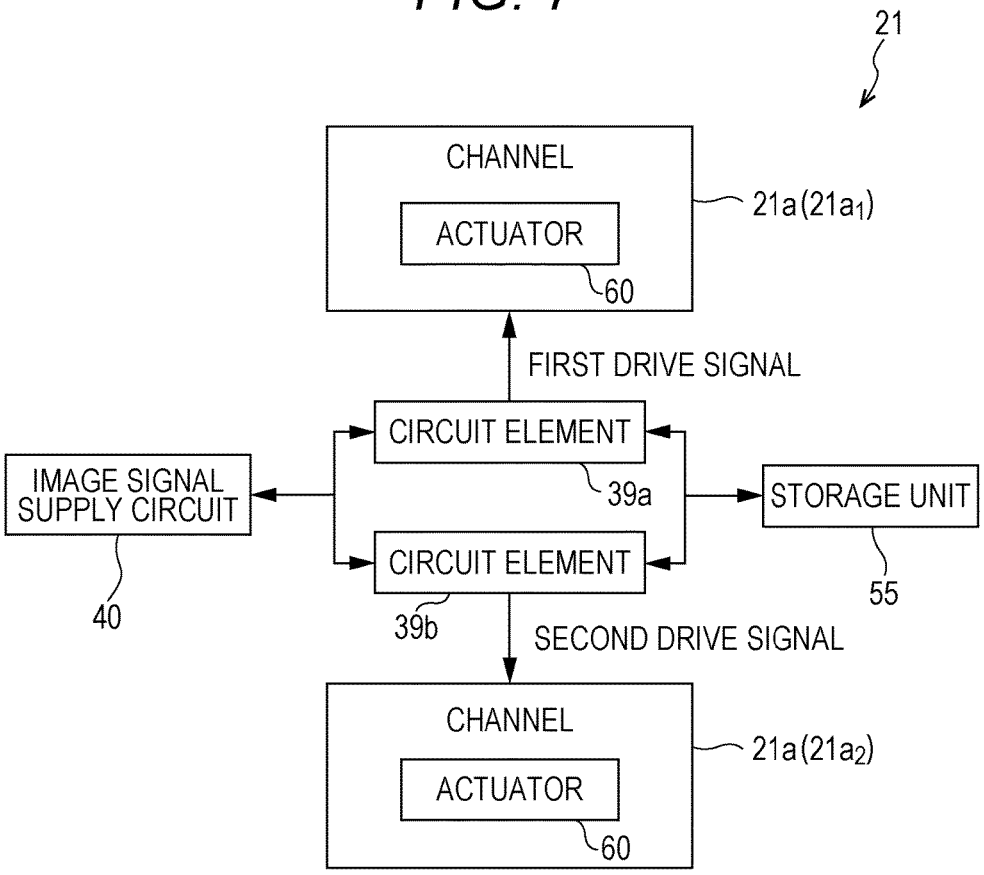
FIG. 7 is a block diagram illustrating an exemplary circuit configuration of the inkjet head.

FIG. 7 is a block diagram illustrating an exemplary circuit configuration of the inkjet head 21 of the present embodiment. The inkjet head 21 includes a storage unit 55 in addition to the above-described configuration. The storage unit 55 stores beforehand a correction value used for correcting a drive signal (drive voltage, for example) of each of the channels 21*a* in accordance with the amount of misalignment between the actuator 60 and the pressure chamber P. The correction value can be obtained as follows. A table indicating the relationship between the amount of misalignment (amount of misalignment in both X- and Y-directions within a plane parallel to the substrate) and the correction value is created beforehand, and the amount of misalignment in both the X- and Y-directions is obtained by measuring individual positions of the actuator 60 and the pressure chamber P by a microscope, or the like, from the opposite side of the substrate, and the correction value corresponding to the obtained amount of misalignment is obtained from the table.

Moreover, it would be allowable to obtain ink ejection characteristic variation generated by the misalignment by actually performing an ink ejection test using the produced inkjet head 21, obtain a correction value capable of reducing the variation, and store the obtained value in the storage unit 55. For example, a case is assumed where the ink ejection test has revealed, among the plurality of channels 21*a*, in a same row, including the pressure chambers P facing different directions, that the ink ejection characteristic declined 5% in the channel $\mathbf{21}a_1$ with the pressure chamber P directed to one direction, while the ink ejection characteristic declined 20% in the channel $\mathbf{21}a_2$ with the pressure chamber P directed to the direction different from the direction of the channel 21$a_1$. In this case, it would be allowable to store R1=(1/0.95) as a correction value R1 used for correcting the drive voltage of the channel 21$a_1$, into the storage unit 55, and store R2=(1/0.80) as a correction value R2 used for correcting the drive voltage of the channel 21$a_2$, into the storage unit 55.

Note that the ink ejection characteristic can be obtained by measuring the amount of displacement (amount of deformation) and the response speed, of the vibration plate 32. The amount of displacement of the vibration plate 32 can be measured by a laser Doppler meter, for example, and the response speed can be obtained by measuring resonance frequency (the higher the resonance frequency, the higher the response speed).

Figure 8:
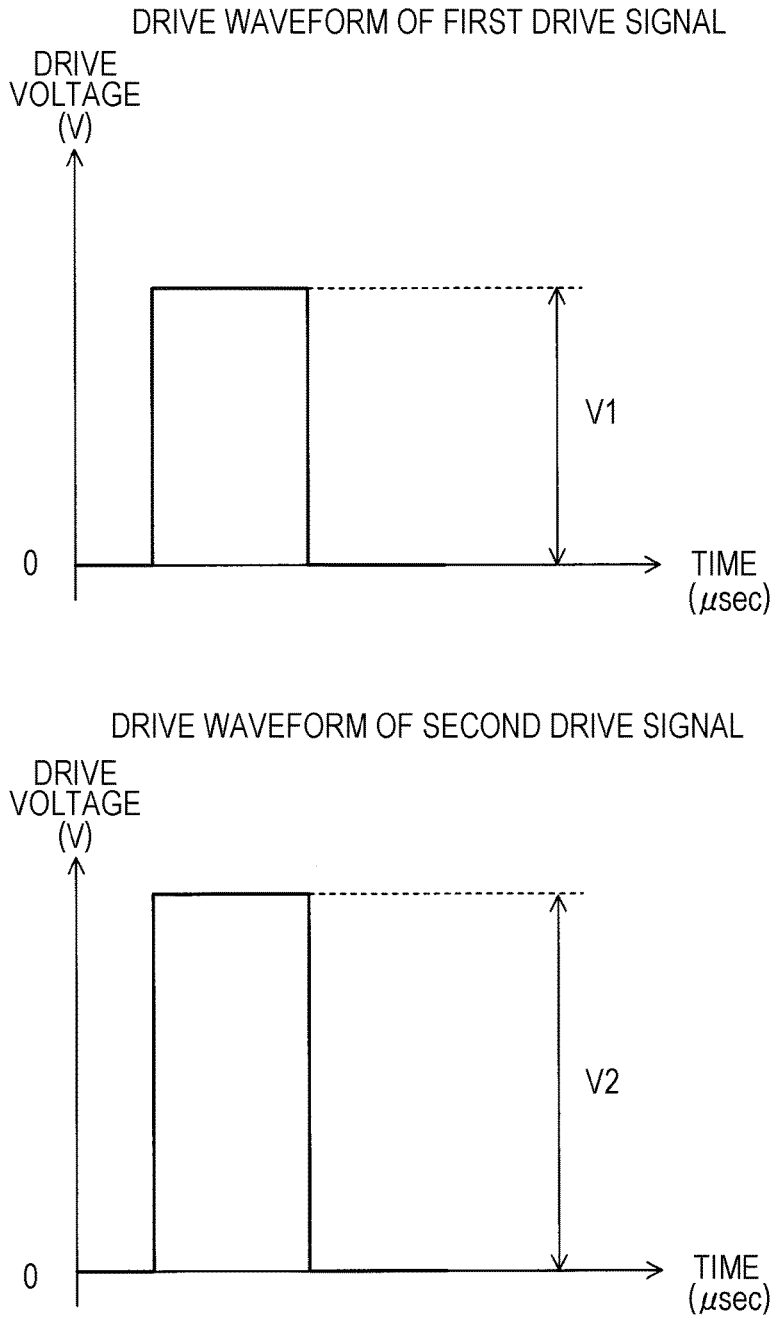
FIG. 8 is a diagram illustrating an exemplary drive signal for driving channels in which directions of the pressure chambers are different in a same row, on the inkjet head.

The circuit elements 39*a* and 39*b* that respectively drive the channel 21$a_1$ and 21$a_2$ with the pressure chambers P having different directions, in a same row, correct the drive signals of the channel 21$a_1$ and 21$a_2$ using correction values stored in the storage unit 55, and respectively drive the channel 21$a_1$ and 21$a_2$ by the corrected drive signals. FIG. 8 illustrates an exemplary drive signal (first drive signal) configured to drive the channel 21$a_1$, and an exemplary drive signal (second drive signal) configured to drive the channel 21$a_2$. For example, as in the latter case of storing the correction values R1 and R2 in the storage unit 55 as described in a latter case above, when it is assumed that normal drive voltage (voltage (potential difference) applied across upper and lower electrodes) for the channels 21$a_1$ and 21$a_2$ is 20V, corrected drive voltage V1 of the channel 21$a_1$ would be 20×(1/0.95)=21.1V, and corrected drive voltage V2 of the channel 21$a_2$ would be 20×(1/0.80)=25V. Since the circuit elements 39*a* drives the channel 21$a_1$ by the drive voltage V1, and the circuit element 39*b* drives the channel 21$a_2$ by the drive voltage V2, the drive voltages become higher than the normal level of 20V, making it possible to suppress ink ejection characteristic deterioration in the channels 21$a_1$ and 21$a_2$ due to the misalignment. Furthermore, by using different drive voltage levels for the channels 21$a_1$ and 21$a_2$ in accordance with the amount of misalignment (amount of reduction of ink ejection characteristic), it is possible to uniformize the ink ejection characteristic between the channels 21$a_1$ and 21$a_2$, and thus, to reduce the ink ejection characteristic variation.

[Operation Flow]

Figure 9A:
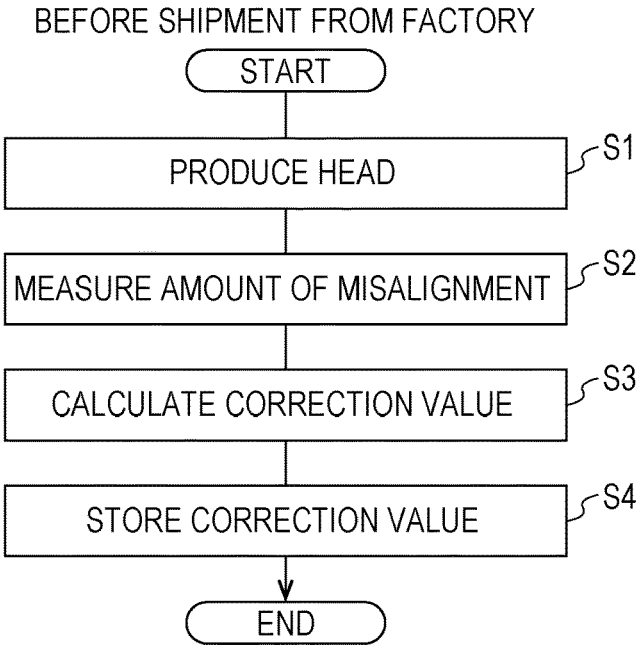
FIG. 9A is a flowchart illustrating a flow of operation of the inkjet head before shipment from a factory.
Figure 9B:
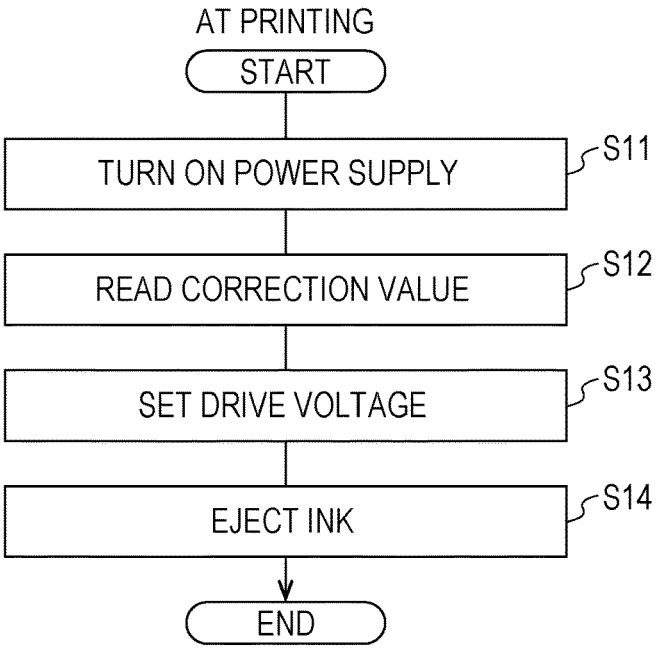
FIG. 9B is a flowchart illustrating a flow of operation of the inkjet head at printing.

FIG. 9A is a flowchart illustrating a flow of operation of the inkjet head 21 before shipment from a factory. FIG. 9B is a flowchart illustrating a flow of operation of the inkjet head 21 at printing after shipment from the factory. Hereinafter, the flow of the operation will be described.

(Before Shipment from Factory)

The inkjet head 21 is produced by the production method (Si), and then, individual positions of the actuator 60 and the pressure chamber P of each of the channels 21*a* are measured from the opposite side of the substrate by a microscope, or the like, so as to obtain the amount of misalignment in both X- and Y-directions (S2). Subsequently, a correction value for the drive signal (e.g. drive voltage) in accordance with the obtained amount of misalignment (S3) is obtained. Note that, as described above, the correction value may be obtained using a table (indicating relationship between amount of misalignment and correction value) or obtained from the ink ejection characteristic measured by the ink ejection test for individual channels. Thereafter, the correction value obtained in S3 is stored in the storage unit 55 of the head (S4).

(At Printing after Shipment from Factory)

Next, a flow of operation at printing will be described. When the power supply of the head is turned on to print on a recording medium (S11), the circuit elements 39*a* and 39*b* read the correction value of the drive voltage stored in the storage unit 55 (S12), set the drive voltage of the channels 21$a_1$ and 21$a_2$ respectively, using the correction value (S13). Subsequently, the circuit elements 39*a* and 39*b* apply the corrected drive voltage onto the channel 21$a_1$ and 21$a_2$ respectively in accordance with image signals, so as to eject ink respectively from the channels 21$a_1$ and 21$a_2$ toward the recording medium (S14).

As described above, the inkjet head 21 according to the present embodiment is configured such that the plurality of channels 21*a* arranged in the same row includes the channel 21$a_1$ and 21$a_2$ having the pressure chambers P facing different directions. Since the channel 21$a_1$ and 21$a_2$ having the pressure chambers P facing different directions are arranged in the same row, it is possible to achieve high resolution by arranging the channels 21*a* with high density in one row, that is the minimum number of rows, compared with the known configuration in which channels including the pressure chambers P facing the same direction are arranged in the same row, and channels including the pressure chambers P facing different directions are arranged in another row. Accordingly, it is possible to achieve high-density arrangement and high-resolution in the channel 21*a* with a configuration using a compact head.

Moreover, in a same row, the channels 21$a_1$ driven by the same circuit element 39*a* are arranged such that the pressure chambers P face a same direction, while the channels 21$a_2$ driven by the same circuit element 39*b* are arranged such that the pressure chambers P face a same direction (although the direction differs from the direction of the pressure chamber P of the channel 21$a_1$) (refer to FIGS. 2 and 3). That is, the channels 21$a_1$ and 21$a_2$ including the pressure chambers P facing different directions are driven by the different circuit elements 39*a* and 39*b*, respectively, in the same row. With this configuration, even when there is ink ejection characteristic variation between the channel 21$a_1$ and 21$a_2$ due to misalignment between the actuator 60 and the pressure chamber P, it is possible to suppress the variation by correcting ink ejection characteristic individually for the channel 21$a_1$ and 21$a_2$. As a result, it is possible to suppress image quality deterioration such as streaks due to the misalignment.

The circuit element 39*a* drives the channels 21$a_1$ including the pressure chambers P facing the same direction by outputting a drive signal (first drive signal) having a same drive waveform at ink ejection, and the circuit element 39*b* drives the channels 21$a_2$ including the pressure chambers P facing the same direction by outputting a drive signal (second drive signal) having a same drive waveform at ink ejection. From this, it is reasonable to consider that, in the inkjet head 21 according to the present embodiment, the channels 21$a_1$ driven by the first drive signal having the same drive waveform at ink ejection are arranged to direct the pressure chamber P in the same direction, and the channel 21$a_2$ driven by the second drive signal having the same drive waveform at ink ejection are arranged to direct the pressure chamber P in the same direction (although the direction differs from the direction of the pressure chamber P of the channel 21$a_1$), in the same row. Even with this configuration, the channel 21$a_1$ and 21$a_2$ including the pressure chambers P facing different directions are driven by different drive signals in the same row, making it possible, similarly to the description above, to suppress image quality deterioration attributed to misalignment between the actuator 60 and the pressure chamber P.

Moreover, in the present embodiment, drive signals (first drive signal and second drive signal) having different drive waveforms at ink ejection are supplied from the different circuit elements 39*a* and 39*b*, respectively. With this configuration, it is possible to reliably drive the channel 21$a_1$ and the channel 21$a_2$ in the same row, having the pressure chambers P facing different directions, using different drive signals.

Moreover, in the channel 21$a_1$ and 21$a_2$ in the same row, the pressure chamber P has a linearly symmetric shape with solely one symmetric axis within a plane parallel to the substrate (e.g., support substrate 31) on which the pressure chamber P is formed (refer to FIG. 3). The symmetric axis is the axis AX along a drawing direction of the drive signal supply wiring (lead-out unit 51*a*) drawn from the actuator 60. The effects can be obtained in the configuration with the pressure chamber P having the shape described above. In particular, when the pressure chamber P has the main-chamber 31*a* and the sub-chamber 31*d*, it is possible to reliably achieve the pressure chamber P having a rotationally asymmetric shape with respect to an axis perpendicular to the substrate and having a linearly symmetric shape with solely one symmetric axis within a plane parallel to the substrate.

Figure 10:
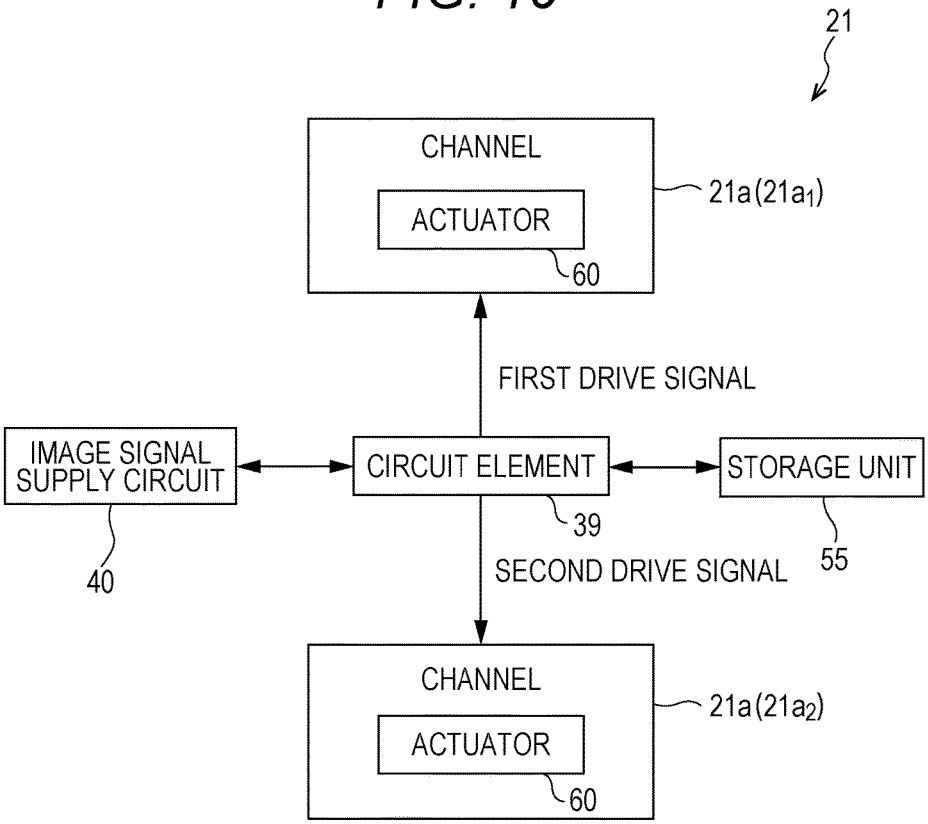
FIG. 10 is a block diagram illustrating another exemplary circuit configuration of the inkjet head.

Meanwhile, FIG. 10 is a block diagram illustrating another exemplary circuit configuration of the inkjet head 21 according to the present embodiment. As illustrated in the diagram, it is allowable to configure such that the drive signals (first drive signal, second drive signal) having different drive waveforms at ink ejection are supplied from the same circuit element 39. For example, when a voltage level regulator for regulating the voltage level (voltage value) supplied from the power supply Vcc, is disposed inside the circuit element 39, it is possible, with the same circuit element 39, to generate a drive signal having different drive voltage levels using a correction value stored in the storage unit 55 and drive the channel 21$a_1$ and 21$a_2$ having pressure chambers P facing different directions in the same row, by different drive signals. This configuration enables the drive control of the channel 21$a_1$ and 21$a_2$ by one circuit element 39, and thus, enables downsizing of the head and low cost, compared with the configuration in which the channel 21$a_1$ and 21$a_2$ in a same row are driven by the plurality of circuit elements 39*a* and 39*b*.

Moreover, the inkjet head 21 further includes the storage unit 55 configured to store the correction values used for correcting the drive signals of the channel 21$a_1$ and 21$a_2$, in accordance with the amount of misalignment between the actuator 60 and the pressure chamber P in the individual channels 21$a_1$ and 21$a_2$. At least one circuit element (the circuit elements 39*a* and 39*b*, or the circuit element 39) configured to drive the channel 21$a_1$ and 21$a_2$ in a same row corrects the drive waveforms of the drive signals of the channel 21$a_1$ and 21$a_2$ using the correction value stored in the storage unit 55 and drives the individual channels 21$a_1$ and 21$a_2$ using the corrected drive signals. This makes it possible to reduce variation in the ink ejection characteristic, generated by misalignment between the actuator 60 and the pressure chamber P on the channels 21$a_1$ and 21$a_2$ in a same row and to reliably suppress image quality deterioration.

Moreover, the actuator 60 is formed on the substrate (support substrate 31 and Si substrate 71*a*) on which the pressure chamber P is formed. With this configuration, as described above, the actuator 60 and the pressure chamber P are formed in different steps when the head is manufactured, and this would be likely to produce variation in the ink ejection characteristic attributed to misalignment between the actuator 60 and the pressure chamber P, within the channels 21$a_1$ and 21$a_2$ in the same row. Accordingly, it would be effective to use the configuration according to the present embodiment, that reduces variation in the ink ejection characteristic by driving the channels 21$a_1$ and 21$a_2$ in a same row by the different circuit elements 39*a* and 39*b*, or different drive signals.

Moreover, as illustrated in FIGS. 4 and 5, the actuator 60 includes, in the order from the pressure chamber P side, the vibration plate 32, the lower electrode 36, the piezoelectric body (piezoelectric thin film 37), and the upper electrode 38. With this configuration using above-configured actuator 60, it is possible to achieve effects of the present embodiment. Moreover, the drive signal supply wiring, drawn from the actuator 60, is the lead-out unit 51*a* drawn from the upper electrode 38. In the configuration in which the actuator 60 is driven by applying voltage to the upper electrode 38 via the lead-out unit 51*a*, it is possible to achieve effects of the present embodiment.

Figure 11:
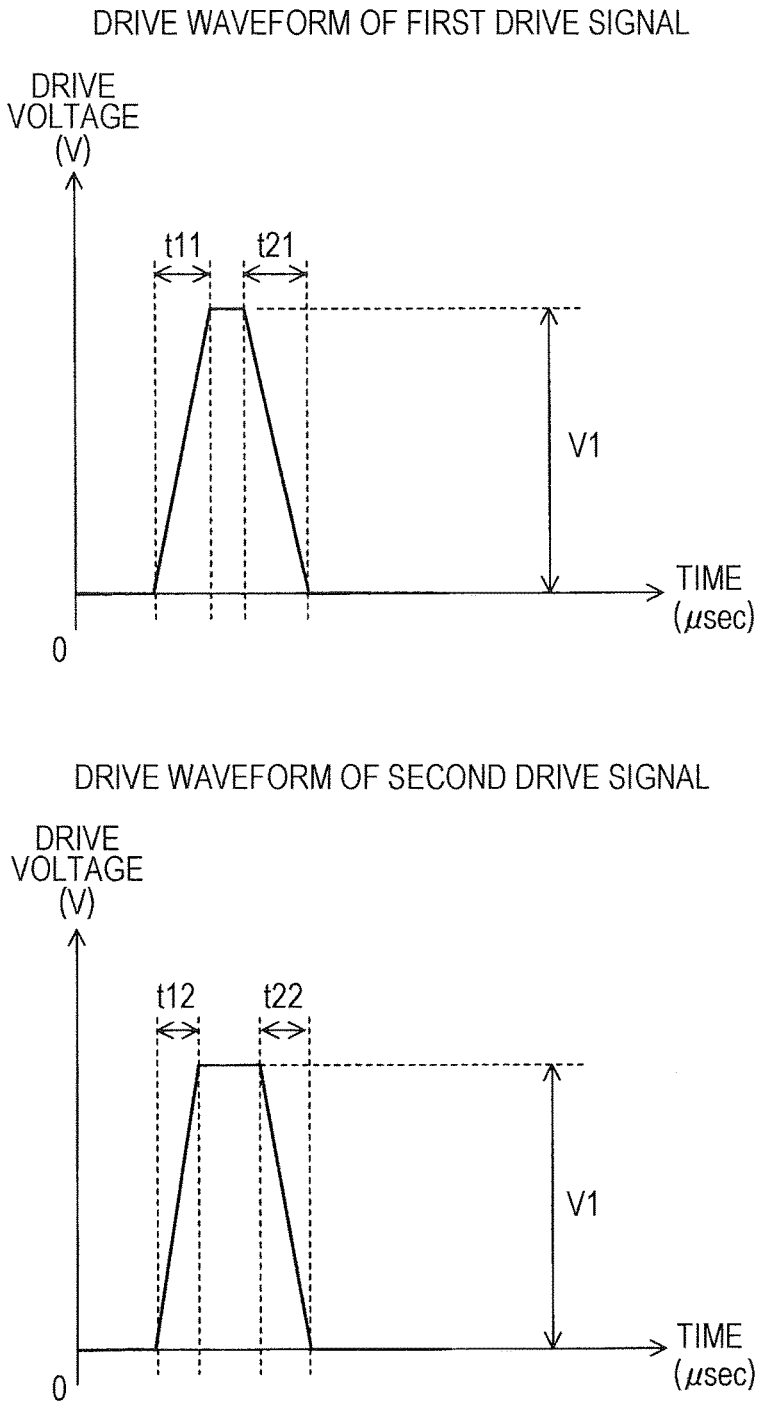
FIG. 11 is a diagram illustrating another example of the drive signal.

Meanwhile, FIG. 11 illustrates another exemplary first drive signal configured to drive the channel 21$a_1$ and another exemplary second drive signal configured to drive the channel 21$a_2$. Correction of the drive signal based on the correction value stored in the storage unit 55 may be at least one of correction of drive waveform (pulse) rise time and drive waveform fall time, other than the correction of drive voltage. For example, when the channel 21$a_1$ and 21$a_2$ are assumed to have fixed drive voltage V1 for drive signals, and rise time and fall time of normal drive signal pulse are assumed to be t10 (ρsec), and t20 (ρsec), respectively, the circuit elements 39*a* may correct the drive signal (drive waveform) of the channel 21$a_1$ such that the pulse rise time t11 would be t10×(1/R1) or the pulse fall time t21 would be t20×(1/R1). Moreover, the circuit element 39*b* may correct the drive signal of the channel 21$a_2$ such that the pulse rise time t12 would be t10×(1/R2)) or the pulse fall time t22 would be t20×(1/R2). In this manner, it would be also possible to reduce variation in the ink ejection characteristic between the channel 21$a_1$ and 21$a_2$ also by driving each of the channels 21$a_1$ and 21$a_2$ using the drive signal in which at least one of the pulse rise time and pulse fall time has been corrected.

Figure 12:
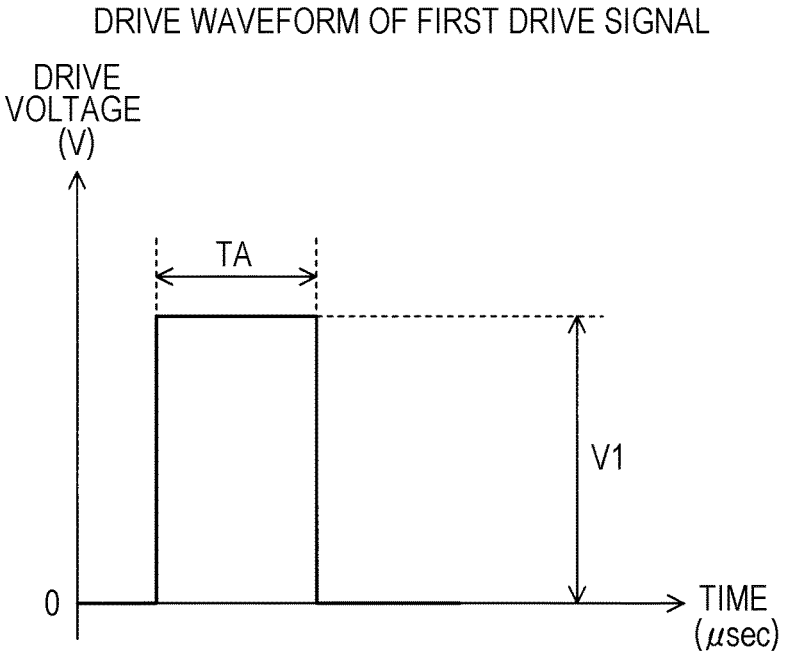
FIG. 12 is a diagram illustrating still another example of the drive signal.
Figure 12:
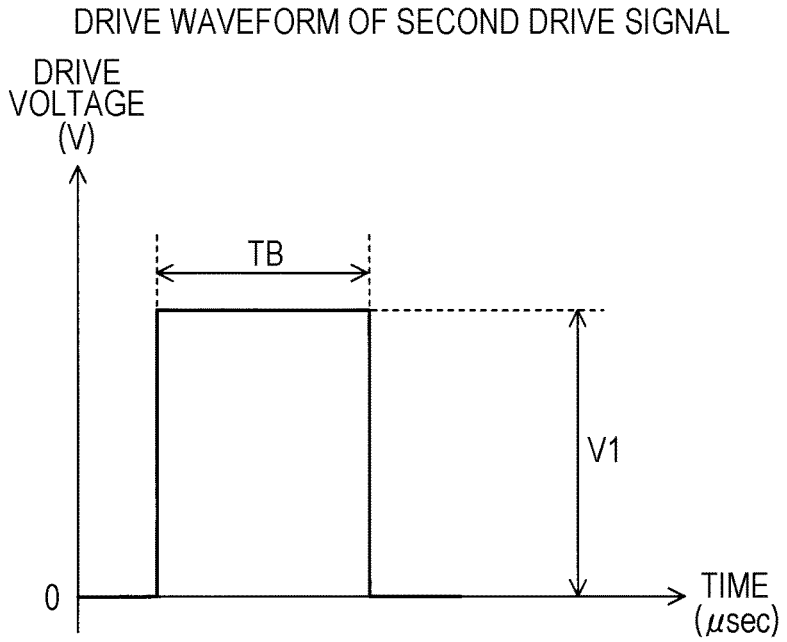

FIG. 12 illustrates still another exemplary drive waveform of the first drive signal configured to drive the channel 21$a_1$ and still another exemplary drive waveform of the second drive signal configured to drive the channel 21$a_2$. Correction of the drive signal based on the correction value stored in the storage unit 55 may be correction of a drive voltage application period. For example, when the drive voltage of the drive signal of the channel 21$a_1$ and 21$a_2$ is assumed to be a fixed voltage V1, and when the normal drive voltage application period is assumed to be T0 (μsec), it is allowable that the circuit elements 39*a* corrects the drive signal (drive waveform) of the channel 21$a_1$ such that an application period TA would be T0×R1. Moreover, the circuit element 39*b* may correct the drive signal of the channel 21$a_2$ such that an application period TB would be T0×R2. In this manner, it would be also possible to reduce variation in the ink ejection characteristic between the channel 21$a_1$ and 21$a_2$ also by driving each of the channels 21$a_1$ and 21$a_2$ using the drive signal in which the drive voltage application period has been corrected.

[Another Configuration of Inkjet Head]

Figure 13A:
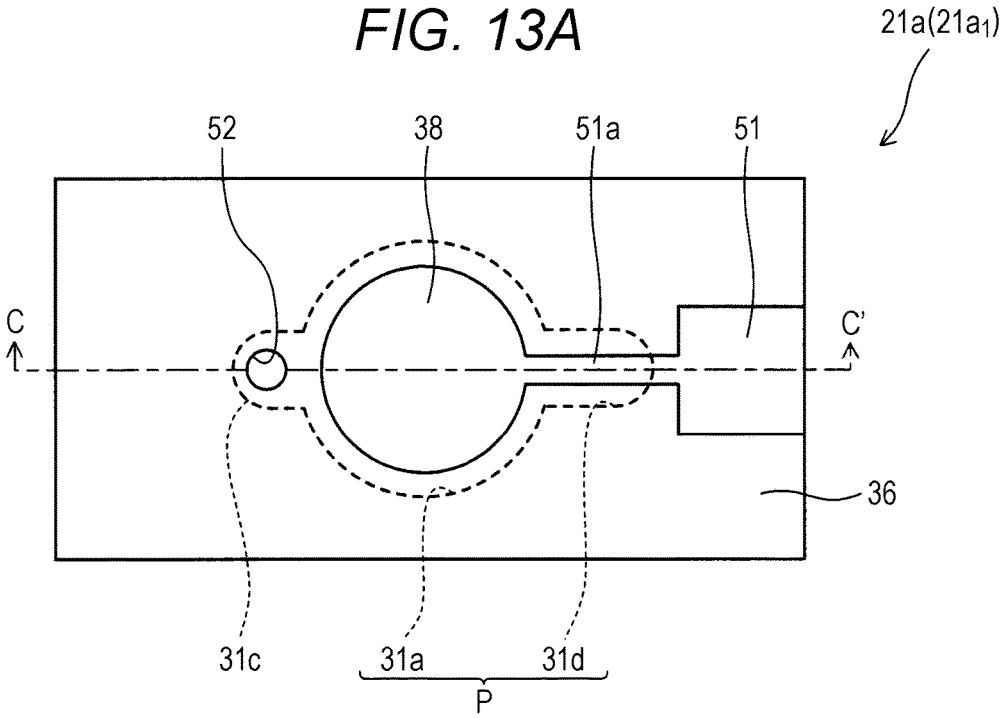
FIG. 13A is a plan view illustrating another configuration of the inkjet head.
Figure 13B:
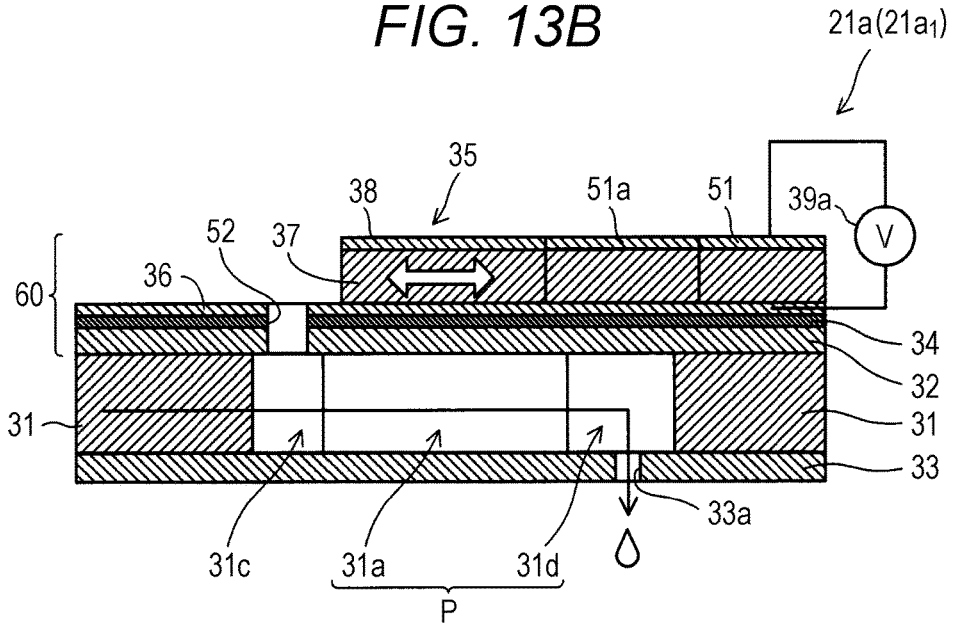
FIG. 13B is a cross-sectional view taken along line C-C' in the plan view.

FIG. 13A illustrates another configuration of the inkjet head 21 according to the present embodiment, illustrating a plan view of one channel 21*a* (21$a_1$). FIG. 13B is a cross-sectional view taken along line C-C' in the plan view. In the inkjet head 21, an ink supply port 52 is provided separately for each of the plurality of channels 21*a* (independently for each, not in a manner shared by the individual channels 21*a*).

The ink supply port 52 is a supply port configured to supply the ink from an ink tank (not illustrated) disposed on the actuator 60 side with respect to the support substrate 31, to each of the pressure chambers P of the plurality of channels 21*a*. The ink supply port 52 is formed at a position opposite to the wiring unit 51 with respect to the pressure chamber P, penetrating through the vibration plate 32, the insulating layer 34, and the lower electrode 36. The ink supply port 52 communicates with the pressure chamber P via the communication passage 31*c* formed on the support substrate 31. The communication passage 31*c* has a width (diameter) larger than the width (diameter) of the ink supply port 52 and smaller than the width (diameter) of the pressure chamber P.

In this manner, by providing the ink supply port 52 separately for the channel 21*a*, it is possible to supply ink to the pressure chamber P using a vertical flow path starting from the ink tank and passing through the ink supply port 52. Accordingly, there would be no need to provide, on the support substrate 31, the ink flow path shared by individual channels 21*a* such as the ink flow path 31*b* illustrated in FIG. 3. With this configuration, it is possible to further downsize the head.

Figure 14:
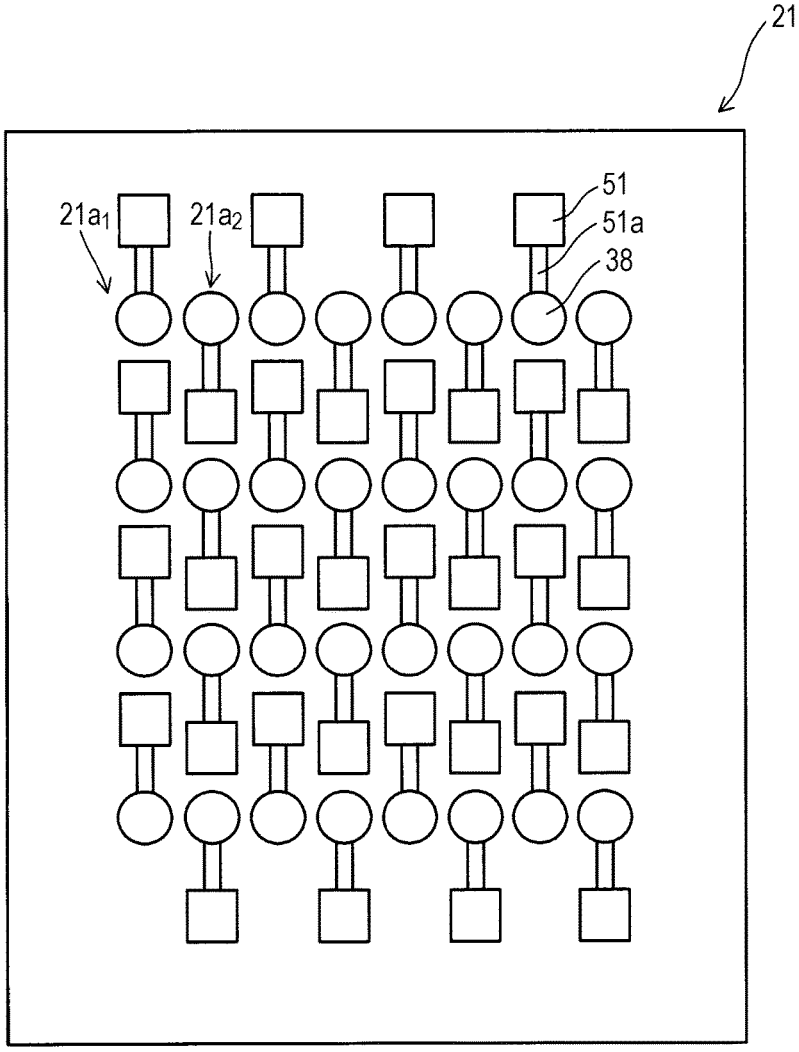
FIG. 14 is a plan view illustrating still another configuration of the inkjet head.

FIG. 14 is a plan view illustration still another configuration of the inkjet head 21 in which the channels 21*a* of FIG. 13A are arranged in a plurality of rows. Note that illustration of the ink supply port 52 is omitted in FIG. 14, for the reason of convenience. For example, in a case where the support substrate 31 has a shared ink flow path, the channels and the shared ink path need to be arranged so as not to cause mutual overlapping in an attempt to arrange the plurality of channels in a plurality of rows to achieve higher resolution, and this might lead to difficulty in arranging the plurality of channels with high density. However, when using the channel 21*a* separately having the ink supply port 52 as illustrated in FIG. 13A, there would be no need to dispose a shared ink flow path on the support substrate 31. This configuration enables arrangement, with small interval in parallel, of a plurality of rows of the channel 21$a_1$ and 21$a_2$ including the pressure chambers P facing different directions. This makes it possible to achieve higher resolution while ensuring necessary strength with a configuration smaller than a case where a shared ink flow path is disposed on the support substrate 31.

[Still Another Configuration of Inkjet Head]

Figure 15:
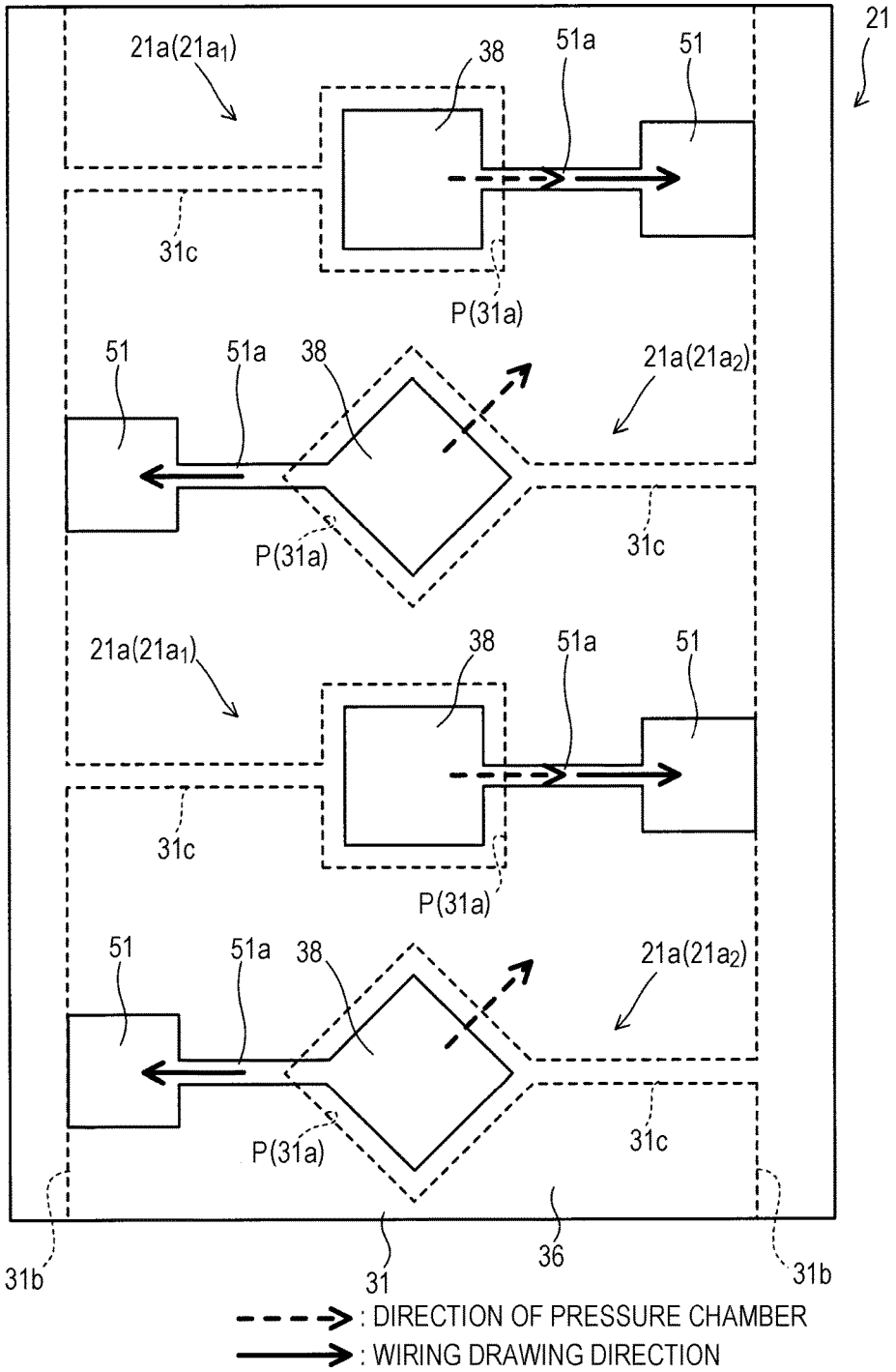
FIG. 15 is a plan view illustrating still another configuration of the inkjet head.

FIG. 15 is a plan view illustrating still another configuration of the inkjet head 21. The shape of the pressure chamber P of the plurality of channels 21$a_1$ and 21$a_2$ arranged in the same row would be only required to be a non-rotating body shape around an axis perpendicular to the substrate (e.g., support substrate 31) on which the pressure chamber P is formed. Accordingly, the shape is not limited to the shape illustrated in FIG. 3. Note that the "non-rotating body shape" means a shape other than the shape formed by rotating a certain plane around an axis perpendicular to the substrate. For example, the non-rotating body shape includes a shape of a polygonal pillar having a polygonal cross-section (including a cube and a rectangular solid) and a pillar shape having an elliptical cross-section. In contrast, the shape such as a cylinder, a cone, and a truncated cone is a rotating body shape formed by rotating a certain plane (e.g. rectangle, triangle, and a trapezoid) around an axis, that is, a side (side parallel to a height direction) of the shape, and excluded from the "non-rotating body shape".

Moreover, the "non-rotating body shape" is formed by building, within a plane parallel to the substrate, a columnar shape from a rotationally asymmetric shape with respect to an axis perpendicular to the substrate, in a direction perpendicular to the substrate. From this formation, the columnar shape having a rotationally asymmetric shaped cross-section within a plane parallel to the substrate can be expressed as a non-rotating body shape. For example, the rotationally asymmetric shape includes polygons (square, rectangle, rhombus, and the like), and ellipse.

FIG. 15 illustrates a case where each of the pressure chambers P has solely the main-chamber 31*a*, with no sub-chamber 31*d*, and where the shape of the pressure chamber P in plan view (shape of cross-section parallel to substrate) is a square. Even in this case, when the pressure chambers P faces different directions in the same row, image quality deterioration attributed to planar misalignment between the actuator 60 and the pressure chamber P might occur (refer to FIG. 20).

Note that while the above description determined that direction of the pressure chamber P as the "direction in the pressure chamber P from the main-chamber 31*a* toward the sub-chamber 31*d*", this definition cannot be applied when the pressure chamber P does not include the sub-chamber 31*d* as illustrated in FIG. 15. Accordingly, in this case, the following definition will be used as the direction of the pressure chamber P. That is, the direction of the pressure chamber P, corresponding to a rotation angle θ (°) from a reference position around an axis perpendicular to the substrate passing through the pressure chamber P, will be defined as the direction of the pressure chamber P. Note that the rotation angle θ is a rotation angle within a plane parallel to the substrate. At this time, the reference position is the position of any one of the pressure chambers P in the head, or the position moved from this position in a direction parallel to the substrate. Moreover, in a case where the positions (shapes) of the pressure chamber P before/after the rotation within the plane match with each other every rotation of N(°), then, it is determined as $0 \leq \theta < N$. Note that it is also possible to determine the direction of the pressure chamber P using this definition even when the pressure chamber P has a rotationally asymmetric shape including the sub-chamber 31*d*.

Figure 16:
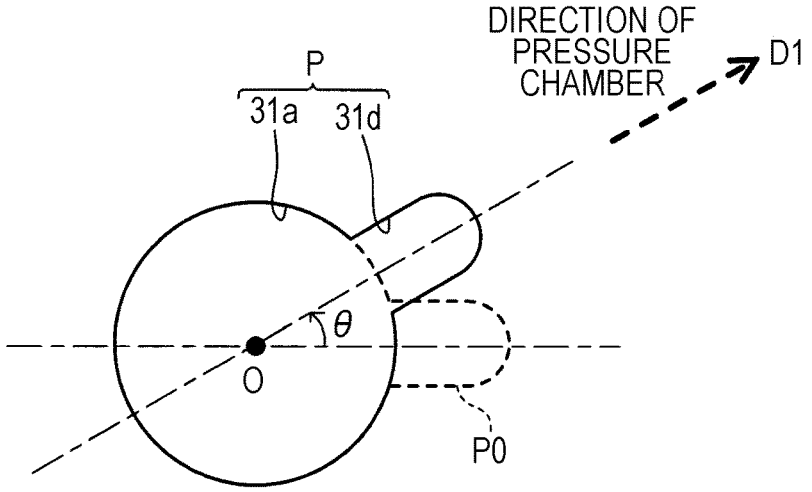
FIG. 16 is a diagram schematically illustrating a position of a pressure chamber having a sub-chamber before/after being rotated within a plane parallel to a substrate from a reference position.

FIG. 16 is a diagram schematically illustrating a position of the pressure chamber P having the sub-chamber 31*d* before/after being rotated within a plane parallel to a substrate from a reference position P0. Note that a rotation center of the pressure chamber P within the plane is determined as O. An axis that is perpendicular to the substrate and passes through the pressure chamber P is assumed to pass through the rotation center O (similar condition is applied in FIG. 17 described below). A direction D1 corresponding to the rotation angle θ (°) from the reference position P0 within the plane matches the initially defined direction of the pressure chamber P, that is, the direction from the main-chamber 31*a* toward the sub-chamber 31*d*. Moreover, since the pressure chamber P in FIG. 16 has a linearly symmetric shape with solely one symmetric axis within a plane parallel to the substrate, the position (shape) of the pressure chamber P before/after rotation would not match with each other unless the rotation angle θ of the pressure chamber P within the plane becomes 360°. Therefore, the possible range of the rotation angle θ would be $0° \leq \theta < 360°$. When applying this definition to the example in FIG. 3, it is reasonable to consider, regarding the channel $21a_1$ and $21a_2$ in the same row, that, when the position of the pressure chamber P of a certain channel $21a_1$ (e.g. channel $21a_1$ at top in FIG. 3) is defined as the reference position P0, the direction of the pressure chambers P of the channel $21a_1$ and the other channel $21a_1$ is the direction corresponding to the rotation angle 0°, and the direction of the pressure chamber P of the channel $21a_2$ is the direction corresponding to the rotation angle 180°.

Figure 17:
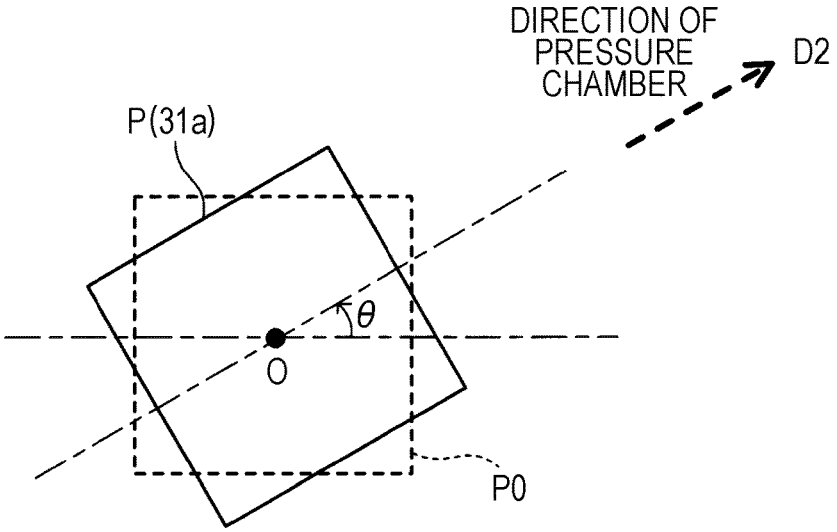
FIG. 17 is a diagram schematically illustrating a position of a pressure chamber without a sub-chamber before/after being rotated within a plane parallel to a substrate from a reference position.
Figure 18A:
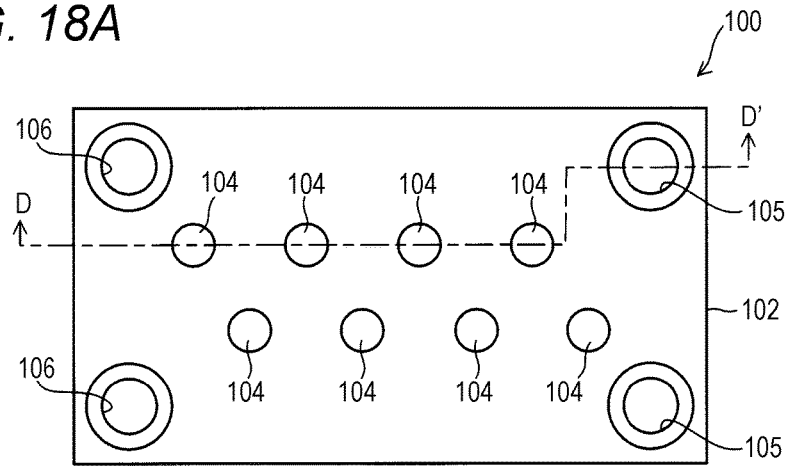
FIG. 18A is a plan view illustrating a schematic configuration of a known inkjet head.
Figure 18B:
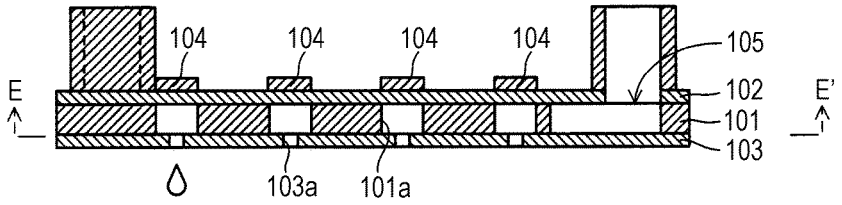
FIG. 18B is a cross-sectional view taken along line D-D' in the plan view.
Figure 18C:
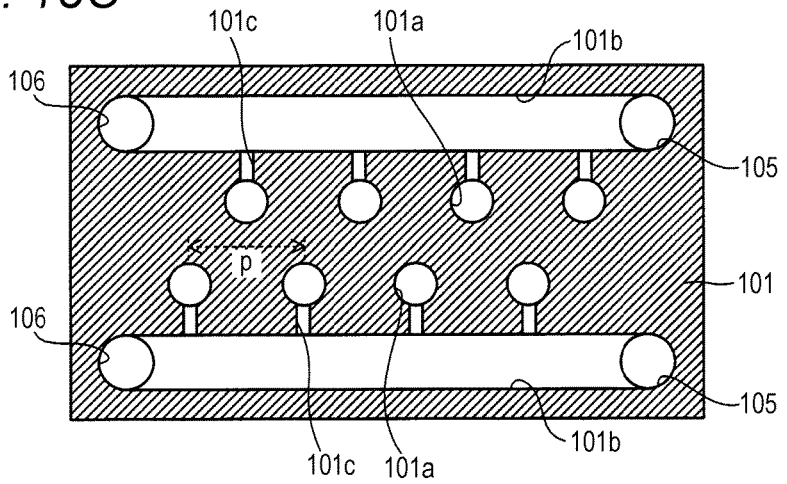
FIG. 18C is a cross-sectional taken along line E-E' in the cross-sectional view.
Figure 19A:
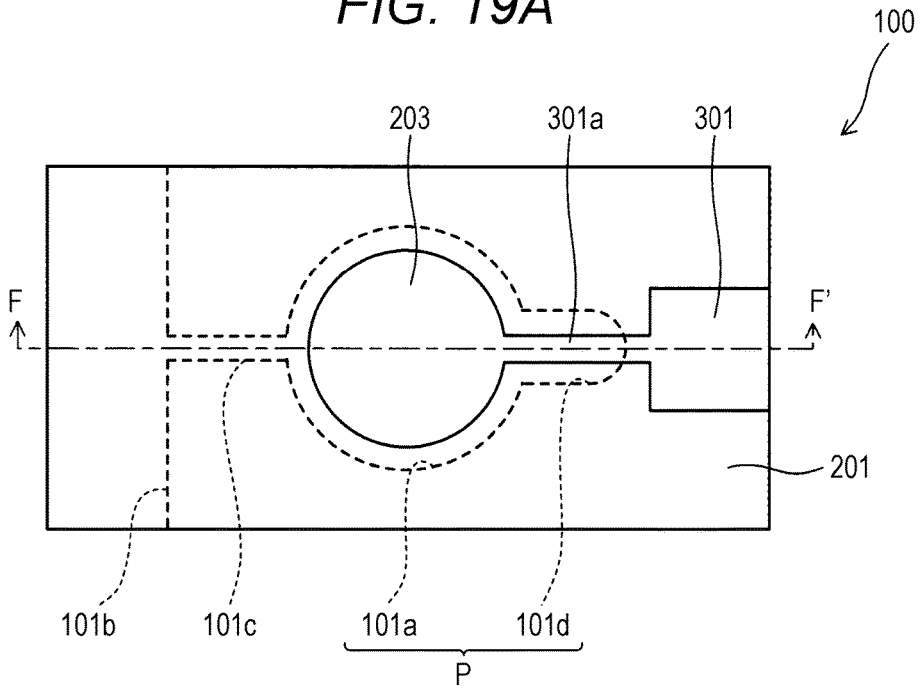
FIG. 19A is a plan view illustrating a channel of the inkjet head.
Figure 19B:
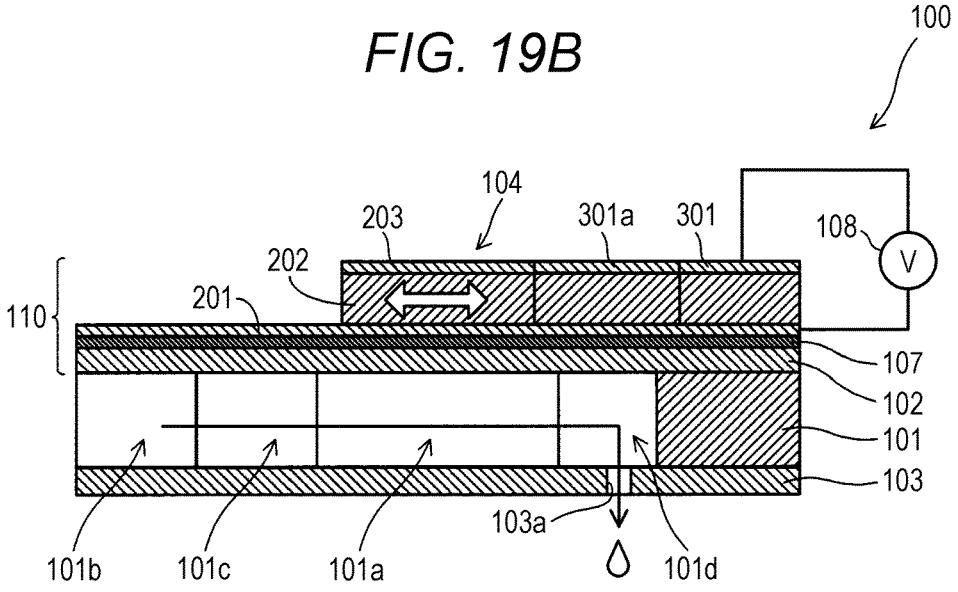
FIG. 19B is a cross-sectional view taken along line F-F' in the plan view.

Meanwhile, FIG. 17 is a diagram schematically illustrating a position of the pressure chamber P having a square shape in plan view without the sub-chamber 31*d*, before/after being rotated within a plane parallel to the substrate from a reference position P0. In this example, a direction D2 corresponding to the rotation angle θ (°) from the reference position P0 within the plane is the direction of the pressure chamber P. In a case where the pressure chamber P has a square shape in plan view, however, the positions (shapes) before/after the rotation match with each other every 90° rotation within the plane, and thus, in consideration of the direction of the pressure chamber P, the rotation angle θ would be $0° \leq \theta < 90°$. When applying the definition to the example in FIG. 15, it is reasonable to consider, regarding the channel $21a_1$ and $21a_2$ in a same row, that, when the position of the pressure chamber P of a certain channel $21a_1$ (e.g. the channel $21a_1$ at top in FIG. 15) is defined as the reference position P0, the direction of the pressure chambers P of the channel $21a_1$ and the other channel $21a_1$ is the direction corresponding to the rotation angle 0°, and the direction of the pressure chamber P of the channel $21a_2$ is the direction corresponding to the rotation angle 45°. Note that the direction of the pressure chamber P and the wiring drawing direction (refer to the solid arrow) do not match with each other in the example of FIG. 15, it would cause no problem in view of the direction of the pressure chamber P.

Moreover, even in the configuration of FIG. 15, the channels $21a_1$ driven by the same circuit element 39*a* (or same first drive signal) are arranged in a same row such that the pressure chambers P face a same direction (rotation angle 0° direction), the channels $21a_2$ driven by the same circuit element 39*b* (or same second drive signal) are arranged such that the pressure chambers P face a same direction (rotation angle 45° direction). That is, the channel $21a_1$ and $21a_2$ including the pressure chambers P facing different directions are driven in the same row by the circuit elements 39*a* and 39*b* (or different drive signals). With this configuration, even when there is ink ejection characteristic variation between the channel $21a_1$ and $21a_2$ due to misalignment between the actuator 60 and the pressure chamber P, it is possible to suppress the variation by correcting ink ejection characteristic individually for the channel $21a_1$ and $21a_2$. As a result, similarly to the case of FIG. 3, it is possible to suppress image quality deterioration such as streaks due to the misalignment.

[Others]

While, the present embodiment has described the case where piezoelectric body of the drive element 35 is formed with the piezoelectric thin film 37 (refer to FIG. 4, or the like), the piezoelectric body may be a bulk material.

The inkjet head described above is an inkjet head including a plurality of channels configured to eject ink from a pressure chamber by the drive of an actuator, in which the pressure chamber in each of the channels has a non-rotating body shape with respect to an axis perpendicular to a substrate on which the pressure chamber is formed, and when a direction corresponding to a rotation angle of the pressure chamber from a reference position around the axis passing through the pressure chamber is defined as a direction of the pressure chamber, the plurality of channels arranged in a same row in a direction parallel to the substrate includes channels having the pressure chambers facing different directions, and the channels driven by a same circuit element in the same row are arranged such that the pressure chambers face a same direction.

According to the above-described configuration, the plurality of channels arranged in a same row includes channels having pressure chambers facing different directions. Accordingly, compared with the case where channels are arranged in a plurality of rows such that the pressure chambers face a same direction in the same row and that the pressure chambers face different directions in another row, it would be possible to achieve high-density arrangement and high resolution due to this arrangement, with the smaller number the rows. That is, it is possible to achieve high-density arrangement and high resolution in the channel with a configuration using a compact head.

Moreover, since the channels driven by the same circuit element are arranged, in the same row, such that the pressure chambers face a same direction, it is possible, in the same row, to drive the channels having the pressure chambers facing different directions by different circuit elements. With this configuration, even when ink ejection characteristic has variation between the channels having pressure chambers facing different directions, due to misalignment between the actuator and the pressure chamber, it is possible to suppress the variation by correcting ink ejection characteristic individually for the channels having pressure chambers facing different directions. With this configuration, it is possible to suppress image quality deterioration such as streaks due to the misalignment.

The channels including the pressure chambers facing different directions may be driven in the same row by the different circuit elements. In this case, it is possible to reliably correct ink ejection characteristic individually for channels having pressure chambers facing different directions, and to reliably suppress variation.

The inkjet head described above is an inkjet head including a plurality of channels configured to eject ink from a pressure chamber by the drive of an actuator, in which the pressure chamber in each of the channels has a non-rotating body shape with respect to an axis perpendicular to a substrate on which the pressure chamber is formed, and when a direction corresponding to a rotation angle of the pressure chamber from a reference position around the axis passing through the pressure chamber is defined as a direction of the pressure chamber, the plurality of channels arranged in a same row in a direction parallel to the substrate includes channels having the pressure chambers facing different directions, and channels driven by a drive signal having a same drive waveform at ink ejection in the same row are arranged such that the pressure chambers face a same direction.

According to the above-described configuration, the plurality of channels arranged in a same row includes channels having pressure chambers facing different directions. Accordingly, compared with the case where channels are arranged in a plurality of rows such that the pressure chambers face a same direction in the same row and that the pressure chambers face different directions in another row, it would be possible to achieve high-density arrangement and high resolution due to this arrangement, with the smaller number of rows. That is, it is possible to achieve high-density arrangement and high resolution in the channel with a configuration using a compact head.

Moreover, since the channels driven by the drive signal having the same drive waveform at ink ejection are arranged, in a same row, such that the pressure chambers face a same direction, it is possible, in the same row, to drive the channels having the pressure chambers facing different directions by different drive signals. With this configuration, even when ink ejection characteristic has variation between the channels having pressure chambers facing different directions, due to misalignment between the actuator and the pressure chamber, it is possible to suppress the variation by correcting ink ejection characteristic individually for the channels having pressure chambers facing different directions. With this configuration, it is possible to suppress image quality deterioration such as streaks due to the misalignment.

The channels including the pressure chambers facing different directions may be driven in the same row by the drive signals having different drive waveforms at ink ejection. In this case, it is possible to reliably correct ink ejection characteristic individually for channels having pressure chambers facing different directions, and to reliably suppress variation.

In the above-described configuration, the different drive signals may be supplied from different circuit elements. In this case, it is possible to reliably drive the channels in a same row, having pressure chambers facing different directions, using different drive signals.

In the above-described configuration, the different drive signals may be supplied from a same circuit element. In this case, this configuration enables drive control of the channels having the pressure chambers facing different directions in a same row, by one circuit element, and thus, enables downsizing of the head and low cost, compared with the configuration in which the channels in the same row are driven by the plurality of circuit elements.

It would be preferable that the inkjet head further includes a storage unit configured to store a correction value used for correcting the drive signal for each of the channels in accordance with the amount of misalignment between the actuator and the pressure chamber, and that at least one of the circuit elements configured to drive each of the channels in a same row drives each of the channels by correcting the drive signal of each of the channels using the correction value.

Since the circuit element drives each of the channels by correcting the drive signal of each of the channels using the correction value stored in the storage unit beforehand, it is possible to reduce the ink ejection characteristic variation generated by misalignment between the actuator and the pressure chamber P on each of the channels, in the same row, having pressure chambers facing different directions, and to reliably suppress image quality deterioration.

It would be allowable that the circuit element corrects, using the correction value, at least any of drive voltage of the drive signal of each of the channels, pulse rise time, pulse fall time, an application period of the drive voltage. With the configuration in which the circuit element corrects the drive voltage, or the like, and each of the channels are driven by the corrected drive signal, it is possible to reliably reduce in ink ejection characteristic variation.

The actuator may be formed on the substrate on which the pressure chamber is formed. With this configuration, head manufacturing includes different steps, namely, a step of forming the pressure chamber on a substrate, and a step of forming the actuator on the substrate, leading to the occurrence of planar misalignment of the actuator with respect to the pressure chamber (misalignment in a direction parallel to the surface of the substrate). Subsequently, this misalignment would easily cause variation in ink ejection characteristic between channels, in a same row, having pressure chamber facing different directions. Therefore, the above-described configuration designed for suppressing image quality deterioration due to the misalignment would be extremely effective.

The ink supply port configured to supply ink from the actuator side to each of the pressure chambers of the plurality of channels may be separately provided for each of the plurality of channels. In this case, there would be no need to dispose, on the support substrate on which a plurality of pressure chambers is formed, a shared ink flow path to supply ink for each of the pressure chambers, making it possible to achieve further downsizing of the head.

It is allowable to provide a plurality of rows in parallel, each of the rows including channels having pressure chambers facing different directions in a same row. Since there is no need to dispose a shared ink flow path on the substrate on which the plurality of pressure chambers is formed, it is possible to achieve high resolution with a smaller configuration compared with the case where the ink flow path is disposed on the substrate, even in a case where the plurality of rows of channels is arranged in parallel so as to achieve higher resolution.

In each of the channels in a same row, the pressure chamber may have a linearly symmetric shape with solely one symmetric axis within a plane parallel to the substrate. In a configuration in which the pressure chamber has a rotationally asymmetric shape around an axis perpendicular to the substrate and a linearly symmetric shape with solely one symmetric axis within a plane parallel to the substrate, it is possible to obtain the effects.

The symmetric axis may be an axis along the drawing direction of the drive signal supply wiring drawn from the actuator. The effects can be obtained in a configuration where the pressure chamber has a linearly symmetric shape around a symmetric axis along with the drawing direction of wiring.

The pressure chamber may include a main-chamber in which drive of the actuator applies pressure to the inside of the chamber, and a sub-chamber that is located beneath the wiring and that communicates with the main-chamber. By forming the pressure chamber including the main-chamber and the sub-chamber, it would be possible to reliably achieve the pressure chamber having a rotationally asymmetric shape around an axis perpendicular to the substrate and a linearly symmetric shape with solely one symmetric axis within a plane parallel to the substrate.

It would be allowable to configure such that the actuator is located above the pressure chamber and includes, in the order from the pressure chamber side, a vibration plate, a lower electrode, a piezoelectric body, and an upper electrode. The effects can be obtained in the inkjet head having the above-configured actuator.

The method for manufacturing the inkjet head according to the present embodiment described above is a method for manufacturing the above-configured inkjet head, in which the actuator and the pressure chamber may be formed in different steps. In this case, planar misalignment of the actuator with respect to the pressure chamber would easily occur as described above, and ink ejection characteristic variation would easily occur among channels in a same row, having pressure chambers facing different directions. Therefore, it would be possible to achieve the effects of suppressing image quality deterioration due to the misalignment, on the inkjet head in which the actuator and the pressure chamber have been formed in different steps.

The inkjet printer described above according to the present embodiment may have a configuration to include the inkjet head, and to eject ink from the inkjet head toward a recording medium. In this case, it is possible to form a high-resolution image on the recording medium, using a compact head.

INDUSTRIAL APPLICABILITY

The inkjet head according to the present invention is applicable to an inkjet printer.

REFERENCE SIGNS LIST

1 inkjet printer
21 inkjet head
21*a*, 21*a*$_1$, 21*a*$_2$ channel
31 support substrate
31*a* main-chamber
31*d* sub-chamber
32 vibration plate
36 lower electrode
37 piezoelectric thin film (piezoelectric body)
38 upper electrode
39, 39*a*, 39*b* circuit element
51*a* lead-out unit (wiring)
52 ink supply port
55 storage unit
60 actuator
AX axis (symmetric axis)
P pressure chamber
P0 reference position
θ rotation angle

The invention claimed is:

1. An inkjet head comprising:

a plurality of channels configured to eject ink from a pressure chamber by drive of an actuator, and a storage unit configured to store a correction value used for correcting the drive signal for each of the channels in accordance with the amount of misalignment between the actuator and the pressure chamber;

wherein the pressure chamber in each of the channels has a non-rotating body shape with respect to an axis perpendicular to a substrate on which the pressure chamber is formed, and when a direction corresponding to a rotation angle of the pressure chamber from a reference position around the axis passing through the pressure chamber is defined as a direction of the pressure chamber, the plurality of channels arranged in a same row in a direction parallel to the substrate includes channels having the pressure chambers facing different directions, the channels driven by a same circuit element in the same row are arranged such that the pressure chambers face a same direction;

wherein the channels including the pressure chambers facing different directions are driven in the same row by different circuit elements; and wherein at least one of the circuit elements configured to drive each of the channels in a same row drives each of the channels by correcting the drive signal of each of the channels using the correction value.

2. The inkjet head according to claim 1, wherein the circuit element corrects, using the correction value, at least any of drive voltage of the drive signal of each of the channels, pulse rise time, pulse fall time, an application period of the drive voltage.

3. The inkjet head according to claim 1, wherein the actuator is formed on the substrate on which the pressure chamber is formed.

4. The inkjet head according to claim 3, wherein an ink supply port configured to supply ink from the actuator side to each of the pressure chambers of the plurality of channels is separately provided for each of the plurality of channels.

5. The inkjet head according to claim 4, wherein a plurality of rows is provided in parallel, each of the rows including the channels having the pressure chambers facing different directions in a same row.

6. The inkjet head according to claim 1, wherein, in each of channels in a same row, the pressure chamber has a linearly symmetric shape with solely one symmetric axis within a plane parallel to the substrate.

7. The inkjet head according to claim 6, wherein the symmetric axis is an axis along a drawing direction of drive signal supply wiring drawn from the actuator.

8. The inkjet head according to claim 7, wherein the pressure chamber includes a main-chamber in which drive of the actuator applies pressure to the inside of the main-chamber, and a sub-chamber that is located beneath the wiring and that communicates with the main-chamber.

9. The inkjet head according to claim 1, wherein the actuator is located above the pressure chamber and includes, in the order from the pressure chamber side, a vibration plate, a lower electrode, a piezoelectric body, and an upper electrode.

10. A method for manufacturing the inkjet head according to claim 1, wherein the actuator and the pressure chamber are formed in different steps.

11. An inkjet printer comprising the inkjet head according to claim 1, the inkjet printer being configured to eject ink from the inkjet head toward a recording medium.

12. An inkjet head comprising a plurality of channels configured to eject ink from a pressure chamber by drive of an actuator, wherein the pressure chamber in each of the channels has a non-rotating body shape with respect to an axis perpendicular to a substrate on which the pressure chamber is formed, and when a direction corresponding to a rotation angle of the pressure chamber from a reference position around the axis passing through the pressure chamber is defined as a direction of the pressure chamber, the plurality of channels arranged in a same row in a direction parallel to the substrate includes channels having the pressure chambers facing different directions, channels driven by a drive signal having a same drive waveform at ink ejection in the same row are arranged such that the pressure chambers face a same direction; and wherein the channels including the pressure chambers facing different directions are driven in the same row by different drive signals having different drive waveforms at ink ejection.

13. The inkjet head according to claim 12,
wherein the different drive signals are supplied from different circuit elements.

14. The inkjet head according to claim 12,
wherein the different drive signals are supplied from a same circuit element.

15. The inkjet head according to claim 12,
wherein the actuator is formed on the substrate on which the pressure chamber is formed.

16. The inkjet head according to claim 12,
wherein, in each of channels in a same row, the pressure chamber has a linearly symmetric shape with solely one symmetric axis within a plane parallel to the substrate.

17. The inkjet head according to claim 12,
wherein the actuator is located above the pressure chamber and includes, in the order from the pressure chamber side, a vibration plate, a lower electrode, a piezoelectric body, and an upper electrode.

18. A method for manufacturing the inkjet head according to claim 12,
wherein the actuator and the pressure chamber are formed in different steps.

19. An inkjet printer comprising the inkjet head according to claim 12,
the inkjet printer being configured to eject ink from the inkjet head toward a recording medium.

* * * * *